US006679152B1

(12) United States Patent
Head et al.

(10) Patent No.: US 6,679,152 B1
(45) Date of Patent: Jan. 20, 2004

(54) FORMING RING WITH ADJUSTABLE DIAMETER FOR BRAID PRODUCTION AND METHOD OF BRAID PRODUCTION

(76) Inventors: Andrew A. Head, 5055 Burley Hills Dr., Cincinnati, OH (US) 45243; John W. Peter, 8500 Wolf Run La., Morrow, OH (US) 45152; Thomas C. Story, 8 E. Arcadia La., Lakeside Park, KY (US) 41017

( * ) Notice: Subject to any disclaimer, the term of this patent is extended or adjusted under 35 U.S.C. 154(b) by 0 days.

(21) Appl. No.: 10/196,438

(22) Filed: Jul. 15, 2002

Related U.S. Application Data

(63) Continuation of application No. 09/996,352, filed on Nov. 28, 2001, now abandoned.
(60) Provisional application No. 60/253,593, filed on Nov. 28, 2000.

(51) Int. Cl.[7] ..... D04C 1/00; D04C 3/00
(52) U.S. Cl. ..... 87/9; 87/11; 87/34; 87/35
(58) Field of Search ..... 87/8, 9, 11, 13, 87/34, 33, 35, 36, 41, 48

(56) References Cited

U.S. PATENT DOCUMENTS

| | | | | | |
|---|---|---|---|---|---|
| 3,599,529 | A | * | 8/1971 | Richardson | 87/19 |
| 4,934,240 | A | * | 6/1990 | Culp et al. | 87/33 |
| 5,032,199 | A | * | 7/1991 | Landry et al. | 156/149 |
| 5,101,556 | A | * | 4/1992 | Fluga et al. | 29/888.046 |
| 5,146,835 | A | * | 9/1992 | McConnell et al. | 87/1 |
| 5,320,696 | A | * | 6/1994 | McConnell et al. | 156/148 |
| 6,024,005 | A | * | 2/2000 | Uozumi | 87/34 |

* cited by examiner

*Primary Examiner*—John J. Calvert
*Assistant Examiner*—Shaun R. Hurley
(74) *Attorney, Agent, or Firm*—Darby & Darby

(57) ABSTRACT

A braiding apparatus and method of forming braided product. The braiding apparatus may have one or more former rings having an adjustable inner diameters. The former rings may have a plurality of elements at least radially movable so that the inner diameter may be adjusted. The former ring may also include means to actuate the elements to adjust the inner diameter. The braided product made by the braiding apparatus may be multi-layered without a winding between layers.

52 Claims, 24 Drawing Sheets

FORMING RING WITH ADJUSTABLE DIAMETER FOR BRAID PRODUCTION AND METHOD OF BRAID PRODUCTION

This is a continuation of U.S. application Ser. No. 09/996,352, filed Nov. 28, 2001, now abandoned, which claims the benefit of U.S. Provisional Application Serial No. 60/253,593, filed Nov. 28, 2000 entitled "FORMING RING WITH ADJUSTABLE DIAMETER FOR BRAD PRODUCTION." All of these prior applications are hereby incorporated by reference in their entirety.

FIELD OF THE INVENTION

This invention relates to braid production, and more particularly to a former ring used in braid production.

BACKGROUND OF THE INVENTION

Braid is typically manufactured using a system of equipment including a braiding machine, a forming device, including a former ring, and a take-up device. The braiding machine-consists of a track plate and yarn carriers. The yarn carriers carry the spools of yarn and use tension controls to release the yarn during processing. Half of the yarn carriers are driven in a clockwise direction and half are driven in a counterclockwise direction. The movement of carriers is guided by the track plate that causes the two sets of opposing carriers to travel in a Maypole fashion. At the point where the yarns consolidate to form the braid (called the fell, braid point, or lock point), a former device is often used to control the dimension and shape of the braided fabric. Traditionally, the former device is a ring that controls the outside diameter of the finished product, a mandrel that controls the inside diameter of the product; or a combination of a ring and a mandrel. The tension required to pull the yarn off of the carrier and to pull the finished braid is supplied by a take-up device. The take-up device applies the force by pulling on the finished braid.

A traditional former ring is a rigid plate containing a specific hole elevated above the track plate and located along the central axis of the plate. FIG. 1 shows a braiding machine braiding yarns and including a former ring. The former ring has two features that impact the formation of the braid: the diameter of the former ring relative to the cross section of the produced braid and the distance between the former ring and the track plate. The relationship between the diameter of the former ring and the cross section of the braid is most significant when the braid is produced on a mandrel because the braid formation is impacted by both the former ring and the mandrel. The former ring is the initial contact point for the yarns as they are braided and the mandrel is the final contact point. Where there is no mandrel, the braid forms naturally based on support by the former ring at the fell point. The optimal relationship is where there is a former ring and a mandrel is to minimize the distance between them. More particularly, the former ring inner diameter is ideally just larger than the outer cross section of the mandrel. For example, the difference in diameter of the outside of the mandrel and the inside of the former ring is on the order of about ¼" or less. Where the mandrel and ring are oriented as concentric circles with common radii, the difference is about ⅛" or less between a radial point on the outer circumference of the mandrel and a radial point for the same radius on the inner diameter of the former ring. In this way, the former ring pushes the braided yarn a short distance to the mandrel with a short path of travel so that braid is pulled tightly against the mandrel, thereby producing a braid with the highest achievable integrity. In addition, the former ring distance from the track plate forces the fell of the fabric to be consistently created at a given distance from the track plate and, thus, enables the creation of a uniform fabric. Traditional former rings include a predetermined and non-adjustable inner diameter. However, such traditional former rings can often be adjusted to change the distance between the former ring and the track plate.

The rigid nature of the inner diameter of traditional former rings enables the creation of a braid with a uniform diameter. However, such former rings also are limited by providing only a predetermined diameter control to the braiding machine. This limitation impacts braid production in several ways. First, braiding machines are generally multi-use machines in that they are used to produce braids with a variety of diameters. Where the diameters change and a former ring is used, the braiding machine must be refitted with a separate former ring. This reduces efficiency in take-down and set-up time for orienting braiding machines for various braids. More particularly, the braiding machine was originally developed to produce many items that require continuous or repetitive braiding operations. Therefore, many changes have to be made to the machine itself for each braid production.

Second, another way that the rigid inner diameter of traditional former rings impacts braid production is with particular braids that have varying cross sections along their length such that the diameter of the braid varies. In order for traditional former rings to be used to produce such braids, at the point of the diameter change, the braiding machine operation must be suspended and the former ring must be replaced with a new former ring with a different diameter. During this exchange, yarn at the location of the former ring may no longer be supported by the ring such that the yarn orientation can change or the braid point can be lost resulting in defects in the braid, an unwinding of the braid produced prior to the exchange or an undesired fiber orientation with respect to the axial position of the braid. As a result, the quality of the braid may be reduced.

Another approach for a former ring to support a braid having a varying cross section is for the former ring to have a diameter that is larger than the largest diameter of the intended braid. More particularly, where a mandrel with a varying cross section is used, the former ring can have a diameter that is slightly larger than the largest cross section of the mandrel. However, for the areas of the mandrel for which the cross section is smaller than the largest cross section, the distance between the inner diameter of the former ring and the outer cross section of the mandrel will no longer be optimized. As a result, the integrity of the braid along the length of the mandrel varies based on the distance of the mandrel from the former ring.

Another aspect of application of a braid to a mandrel is the formation of a two-layer braid on the mandrel. One traditional approach is to apply a single layer of braid to the mandrel based on the mandrel's vertical movement in one direction. Then, at the point on the mandrel where the second layer is to begin, a winding is manually applied over the braid on the mandrel in order to secure the braid against the mandrel. The manual operation may include, for example, physically wrapping a yarn material around the braid over the mandrel and securing it at the completion of winding or taping the braid to the mandrel, etc. The winding may include, for example, carbon fiber, aramid fiber or any other filament with adequate strength. In this way, the braid can be locked onto the mandrel. The manual winding process requires an off-line process (i.e., outside the automated braiding process) subject to manual errors and separate set-up and take-down time for the process as well as off-line processing time to actually apply the winding. In addition, the quality of the manual operation is dependent on the quality of the particular operation and is not consistent for future braid production.

Hence, there is a need for a former ring that overcomes the above described limitations of traditional former rings having rigid inner diameters and for a device to overcome the limitations of the approach described above for applying multiple layers of braid to a mandrel.

SUMMARY OF THE INVENTION

It is an object of the present invention to provide a former ring that reduces the take-down and set-up time for orienting braiding machines for various braids.

It is an object of the present invention to provide a former ring that can support braid production for a mandrel with a varying outer cross section without exchanging the ring during production.

It is an object of the present invention to provide a former ring that can support braid production for a mandrel with a varying outer cross section without the resulting braid having varying integrity along its length.

It is an object of the present invention to provide a device to overcome the limitations of a winding device for use in the application of multiple braid layers to a mandrel.

According to the present invention, a former ring may include an adjustable inner diameter that can be changed in an automated fashion. The adjustable forming ring may change diameter in order to accommodate changes in the cross section of a mandrel onto which the braid is produced or to expedite speed of set-up or take-down for braiding machines based on a variety of braid geometries, including braids with a constant or variable cross sections.

BRIEF DESCRIPTION OF THE DRAWINGS

The foregoing and other features and advantages of the present invention will be more readily apparent from the following detailed description when read in conjuntion with the accompanying drawings, wherein.

DETAILED DESCRIPTION OF EMBODIMENTS OF THE PRESENT INVENTION

Figure 1:
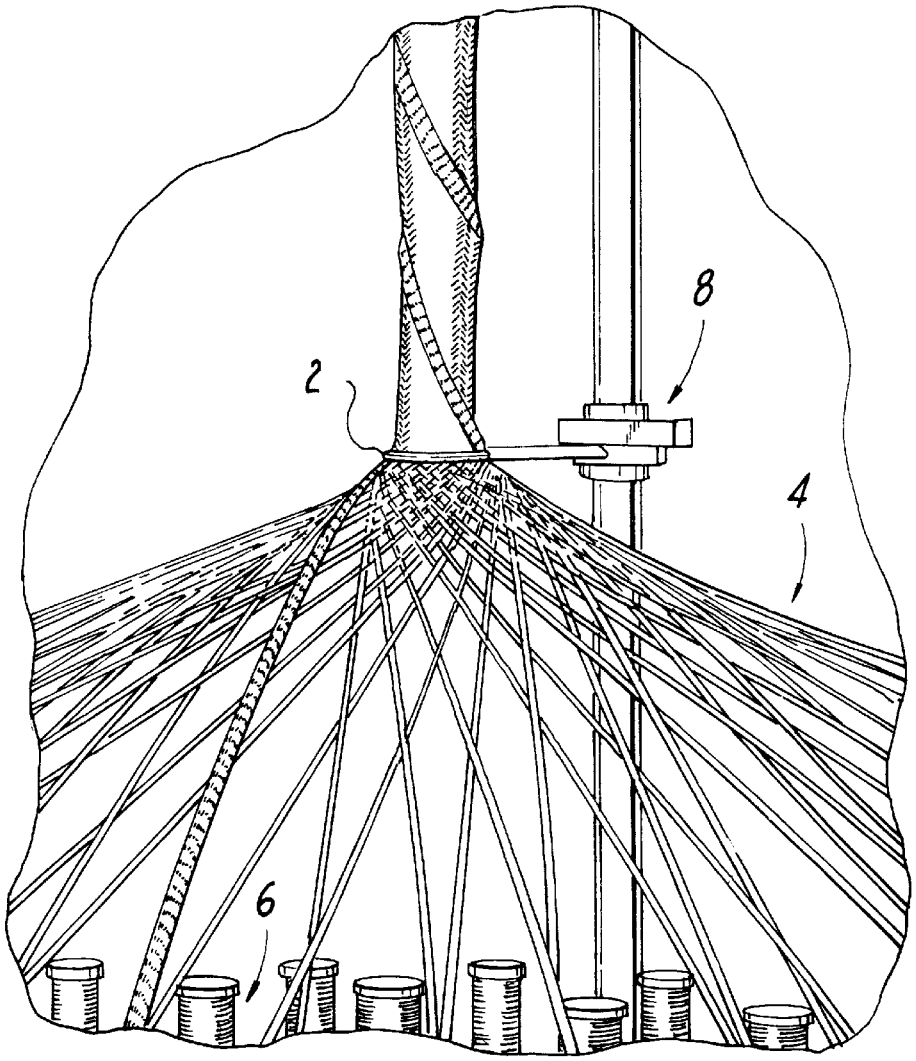
FIG. 1 (Prior Art)
FIG. 1 is a perspective view of a prior art former ring with yarn moving through the former ring to be braided and of yarn carriers that supply the yarn.

FIG. 1 is a perspective view of a prior art former ring 2 with yarn 4 moving through the former ring 2 to be braided and of yarn carriers 6 that supply the yarn. The former ring 2 has a rigid inner diameter. However, the distance between the former ring 2 and the track plate (not shown) is adjustable based on activation of the clamp 8 and vertical movement of the former ring in a vertical orientation.

Figure 2:
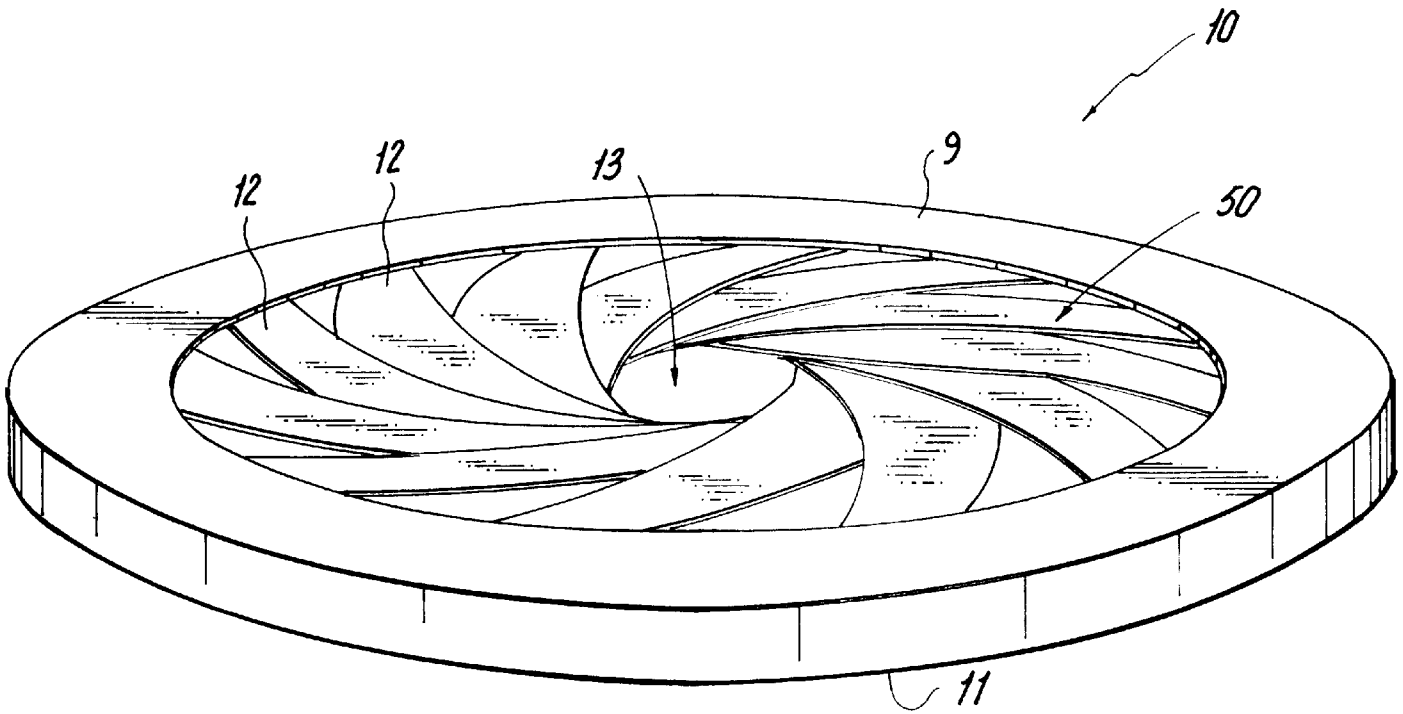
FIG. 2 is a perspective view of a former ring according to an embodiment of the present invention, including the leaves of the former ring being partially closed.

FIG. 2 is a perspective view of a former ring 10 according to an embodiment of the present invention, including the leaves 12 of the former ring 10 being partially closed. In alternative embodiments of the former ring 10, the closed position of the leaves 12 may form an orifice, for example, as shown in FIG. 2, or may create a plate with no orifice (i.e., similar to the use of a camera iris). Whether the closed position of leaves 12 produces an orifice or not depends on the geometry and thickness of the leaves 12. In addition, the leaves 12 of the former ring may be oriented in a variety of positions so that the inner diameter or orifice 13 of the former ring 12 changes. In this embodiment, the orifice 13 approximates the shape of a circle based on the shape of the inner circumferences of the leaves 12 and the positioning of the leaves 12 such that particular areas of their inner circumferences form the orifice 13. Also, in this embodiment, twelve leaves form the adjustable unit of the former ring 12. However, in alternative embodiments, any number of leaves 12 may be implemented such that they enable adjustment of the former ring's inner diameter. The leaves may be formed by any material sufficient to carry the load generated on them during the braiding process, such as 305 stainless steel or plastic.

There are several purposes of a former ring 12 with an adjustable inner diameter. First, where the former ring 12 is implemented to facilitate the application of braid (not shown) to a mandrel (not shown) and the mandrel has at least one variation in cross section along its length, the former ring 12 can change diameter in order to maintain optimal, e.g., closest, fit to the mandrel's changing diameter. This is because when the mandrel cross section changes, the braiding angle can change such that point of braiding formation or the fell point also can change. With a fixed former ring inner diameter, the fell point can move above or below the ring in this scenario. Therefore, in order to maintain the fell point as close to the former ring as possible and to maintain the former ring with as tight a fit to the changing cross section of the mandrel, the inner diameter of the former ring according to an embodiment of this invention may be implemented. Second, the automatic adjustment of the former ring's 10 inner diameter reduces set-up and take-down times for the braiding machine. For example, we have found that the set-up and take-down times based on the use of the former ring 12 have been eliminated.

In addition, the former ring 10 adjustments to the inner diameter may be combined with the vertical adjustment of the former ring in order to change the distance between the former ring 10 and the track plate (not shown).

An algorithm for controlling the inner diameter adjustment of the former ring 10 is as follows:

1) The braid machine is powered and the braider gears rotate. An encoder that is mechanically linked to the braider gears sends position signals to a main controller that controls the devices of the braiding machine. These components are well known to those of ordinary skill in the art and are adapted from devices in present use in braiding machines. Therefore, they will not be further described herein.
2. The mandrel 14 is raised or lowered by a mandrel position servo axis at a programmed ratio in relation to the braider encoder signals. This provides the ability to change the speed of movement of the mandrel 14 in order to change the fiber orientation of the braid 16 along the length of the mandrel 14.
3) Mandrel 14 cross section data (i.e., the diameter of the mandrel 14) are programmed into the controller. The data is placed in a table that associates the mandrel 14 diameter with a position along the longitudinal axis of the mandrel 14.
4) The controller monitors the mandrel's 14 vertical position in relation to the former ring 10 during the braiding process. When vertical positions in the data table are surpassed, the controller sends a signal to the power source for the former ring 10 to adjust the ring 10 inner diameter to a diameter listed in the table. In one embodiment, the power source includes three air solenoids that are fired sequentially in order to move the leaves 12 in a stepwise fashion. If a particular firing sequence is repeated, the iris inner diameter will increase. If the same firing sequence is reversed the iris inner diameter will decrease. In addition, in an alternative embodiment where a servo motor is used, the movement of the iris inner diameter is based on servo motor control, as described in FIG. 19. There is also an encoder on the former ring 10 that provides feedback to the controller in order to determine if the former ring 10 moved properly.

Each of the leaves 12 is sandwiched in between two plates 9 and 11, as described further below, with one end of the leaf 12 connected to one plate 9 and the other end of the leaf 12 connected to the opposite plate 11. In addition, the leaves 12 are further oriented in a fanned and interlocked relationship with one another and with equal spacing between each other, e.g., circumferentially around the former. The fanned feature may be analogized to a deck of cards that are fanned to enable display of a number of cards at the same time. The interlocking feature means that the fanned leaves 12 are oriented to form a complete circle such that there is overlapping of the leaves 12 and further connections of opposite sides of each leaf 12 to a separate one of the plates 9 and 11 in between which the leaves 12 are sandwiched. This orientation of the leaves 12 within the plates 9 and 11 may be based on a traditional camera iris, which is well known to those of ordinary skill in the art and is further available on ubiquitous commercially available cameras.

In alternative embodiments according to the present invention, the leaves 50 may be designed and/or oriented such that their inner circumferences that comprise the interior of the former ring 12 may generate a shape other than approximating a circle. For example, the inner circumference of each leaf 12 may include a shape that when combined forms any number of shapes, including a shape with angles so that it approximates a square, rectangle or triangle as well as any amorphous shapes. As another example, particular leaves 12 may be excluded from the former ring 12 such that different portions of the remaining leaves 12 circumferences form any number of shapes, including a shape with angles so that it approximates a square, rectangle or triangle as well as any amorphous shapes. Such variety of shapes may be implemented to accommodate a mandrel 14 with a corresponding shape other than a circle.

Figure 3:
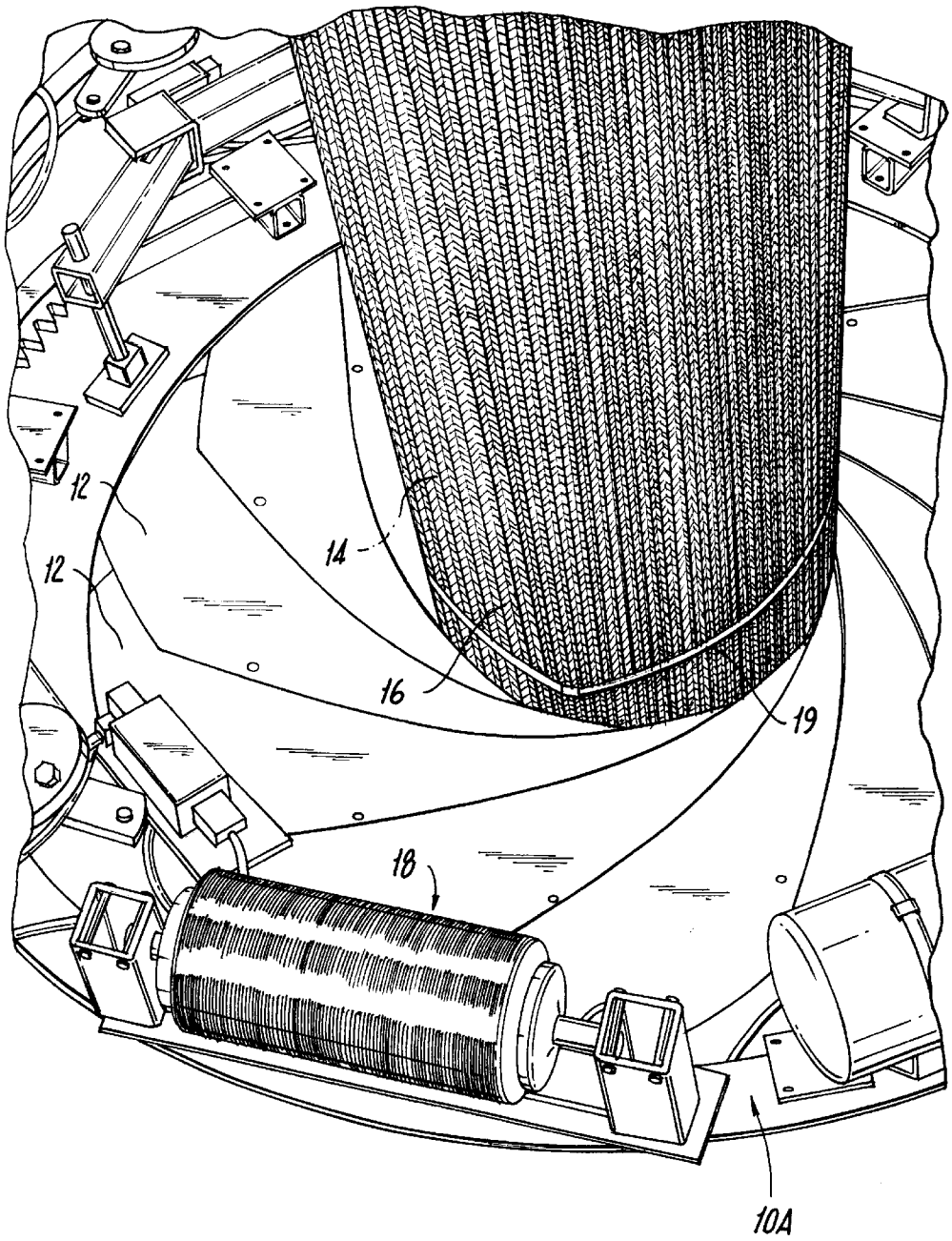
FIG. 3 is a perspective view of a former ring according to an embodiment of the present invention, including leaves of the former ring coming into contact with the mandrel overlaid with a braided layer, and a winding apparatus.

FIG. 3 is a perspective view of a former ring 10*a* according to another embodiment of the present invention, including leaves 12 of the former ring coming into contact with the mandrel 14 overlaid with a braided layer 16 and an automated or in-line (i.e., included as part of the automated braided process) winding apparatus 18. In this embodiment, the former ring 10*a* is used in order for applying two layers of braid 16 to the mandrel 14 by facilitating locking the first braided layer 16 on the mandrel 14 so that a second layer of braid (not shown) may be applied by moving the mandrel vertically in the opposite direction. The traditional method of locking the first braided layer 16 is to manually apply a winding length of yarn 19 to the mandrel 14 in order to secure the braided layer 16 in place. The manual winding process requires an off-line process (i.e., outside the automated braiding process) subject to manual errors and separate set-up and take-down time for the process as well as off-line processing time to actually apply the winding. In addition, the quality of the manual operation is dependent on the quality of the particular operation and is not consistent for future braid production.

According to the FIG. 3 embodiment of the present invention, the former ring 10*a* that optimally is about ¼"

larger in diameter than the mandrel 14 facilitates an automated winding apparatus 18 where multiple braided layers are formed on a mandrel 14 with a constant cross section and is necessary for an automated winding apparatus 18 where multiple braided layers are formed on a mandrel 14 with a varying cross section. Regarding a mandrel 14 with a constant cross section, the braid point or fell point occurs very close to the mandrel 14 such that automated application of winding in the vicinity of the former ring 10*a* will occur on braid that is close-aligned with the mandrel 14. As a result, the braid orientation is already in place so that the winding apparatus 18 will merely lock the braid 16 onto the mandrel 14. In addition, for subsequent uses of the braiding machine (not shown), the automated adjustment of the former ring 10 enables the close proximity of the ring 10 to the mandrel 14 regardless of the cross section of a particular mandrel 14. This reduces set-up and take-down time between uses of the braiding machine. In addition, the fact that the former ring 10 is in close proximity for each use of the braiding machine enables the consistent use of the automated winding apparatus 18 because the braid or fell point in relation to the mandrel 14 surface is optimized based on the adjustable former ring 10*a*.

Regarding a mandrel 14 with a varying cross section, the adjustable former ring 10*a* is necessary in order to implement automated winding with the winding apparatus 18. This is because as the cross section of the mandrel 14 changes, without a former ring with an adjustable inner diameter, the distance between the former ring and the mandrel 14 would change depending on the cross section of the mandrel 14 at the braid formation point. As a result, the braid or fell point can move away from the mandrel 14 when the changing cross section of the mandrel 14 results in a greater distance between the mandrel 14 and the former ring with a fixed diameter. If the automated winding 18 is implemented at such a point, the winding can cause the braid orientation to change as the winding is applied to the braid over the mandrel, resulting in an unacceptable quality of the braid locked onto the mandrel. In contrast, the winding apparatus 18 may be implemented at any point along a mandrel 14 with a varying cross section where the former ring 10*a* may automatically be adjusted to maintain an optimal distance between the mandrel 14 and the ring 10*a*. In this way, the close proximity of the braid point to the mandrel 14 enables the winding 18 to consistently lock a high quality braid orientation to the mandrel 14.

Figure 4:
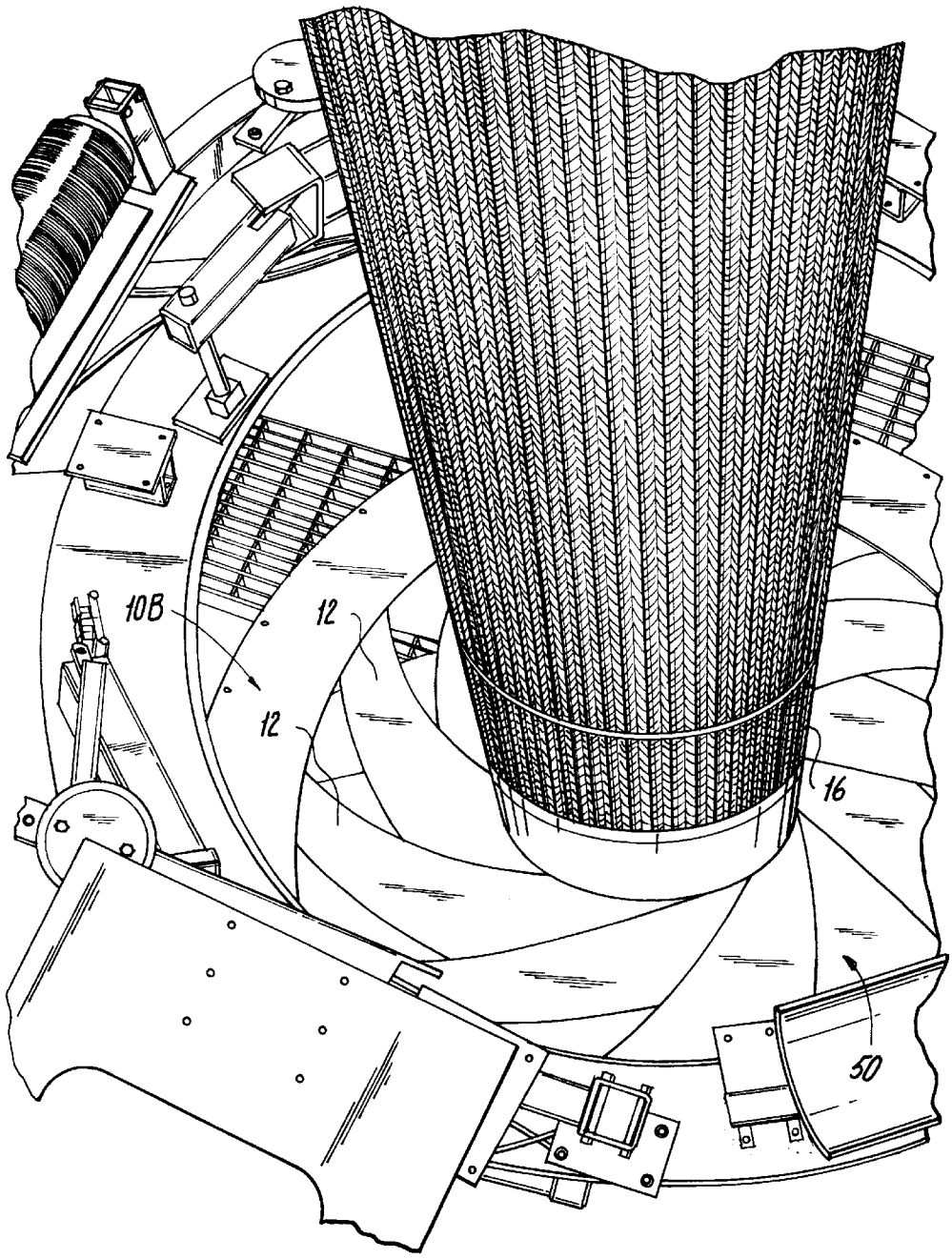
FIG. 4 is the perspective view of FIG. 3 including a second former ring located beneath the former ring depicted in FIG. 3, including leaves of the second former ring coming into contact with the mandrel overlaid with a braided layer.

FIG. 4 is the perspective view of FIG. 3 including another former ring 10*b* located beneath the FIG. 3 former ring 10*a*, including leaves 50 of the former ring 10*b* coming into contact with the mandrel 14 overlaid with a braided layer 16. This figure demonstrates another feature of applying multiple braided layers to the mandrel 14. After the winding 18 process is applied to lock the first braided layer 16 onto the mandrel 14, the mandrel 14 is moved vertically in the opposite direction for application of the second braid (not shown). During the application of the second layer of braid (not shown), a separate former ring 10*b* is used to guide the braid to the mandrel 14 because the braid is traveling toward the mandrel 14 from the opposite direction such that a separate former ring 10*b* facilitates the transition between opposite directions.

Figure 5:
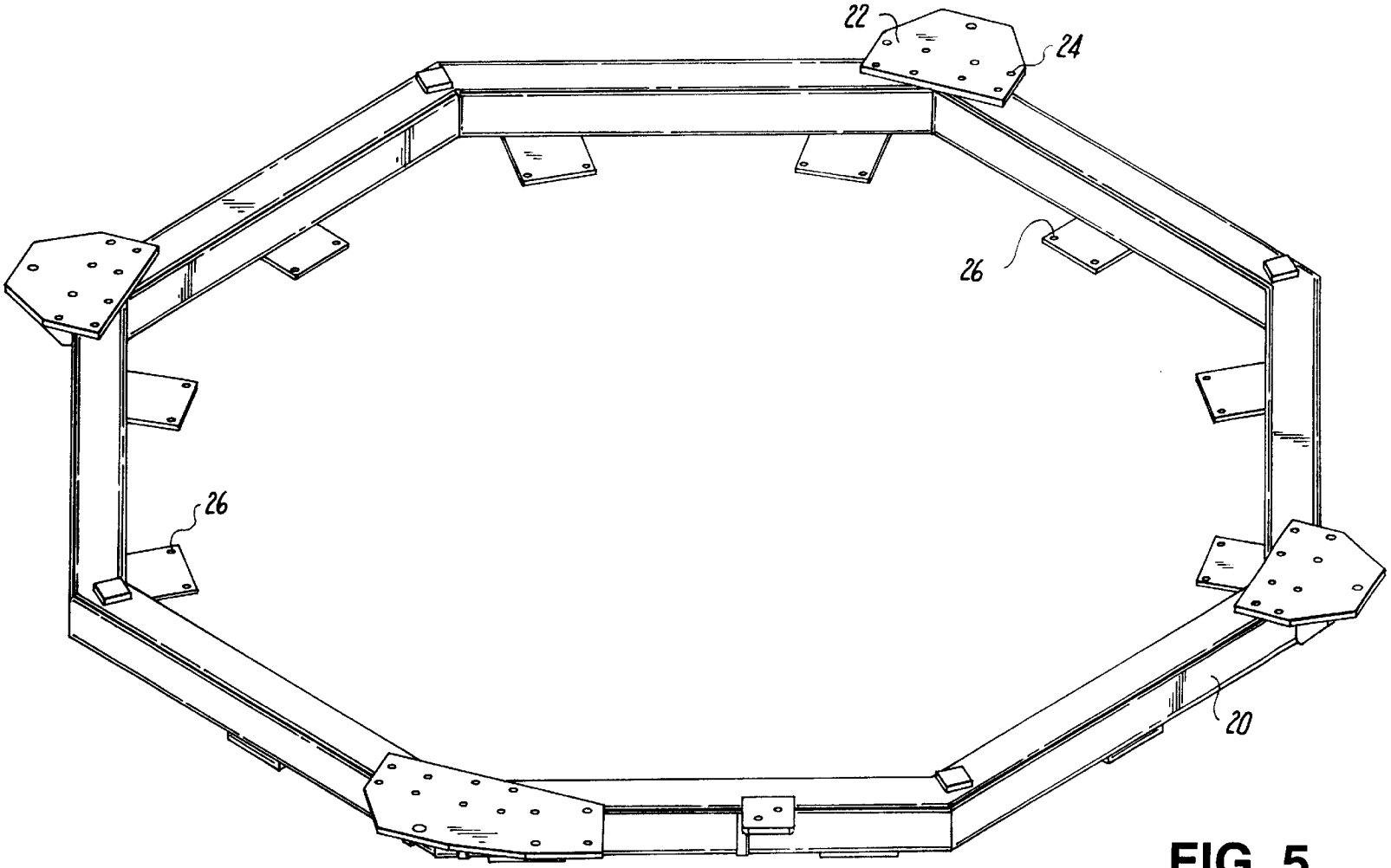
FIG. 5 is a perspective view of a top support frame for a former ring according to the present invention.

FIG. 5 is a perspective view of a top support frame 20 for a former ring. The frame 20 includes first and second top support plate upper bolts 22 and 24, respectively, with which frame 20 connects to the braiding machine or to a stationary structure. Also, the frame 20 includes top support plate lower bolts 26 that connect to bolts 43 on the plate 40 beneath this frame 20 shown in FIG. 6.

Figure 6:
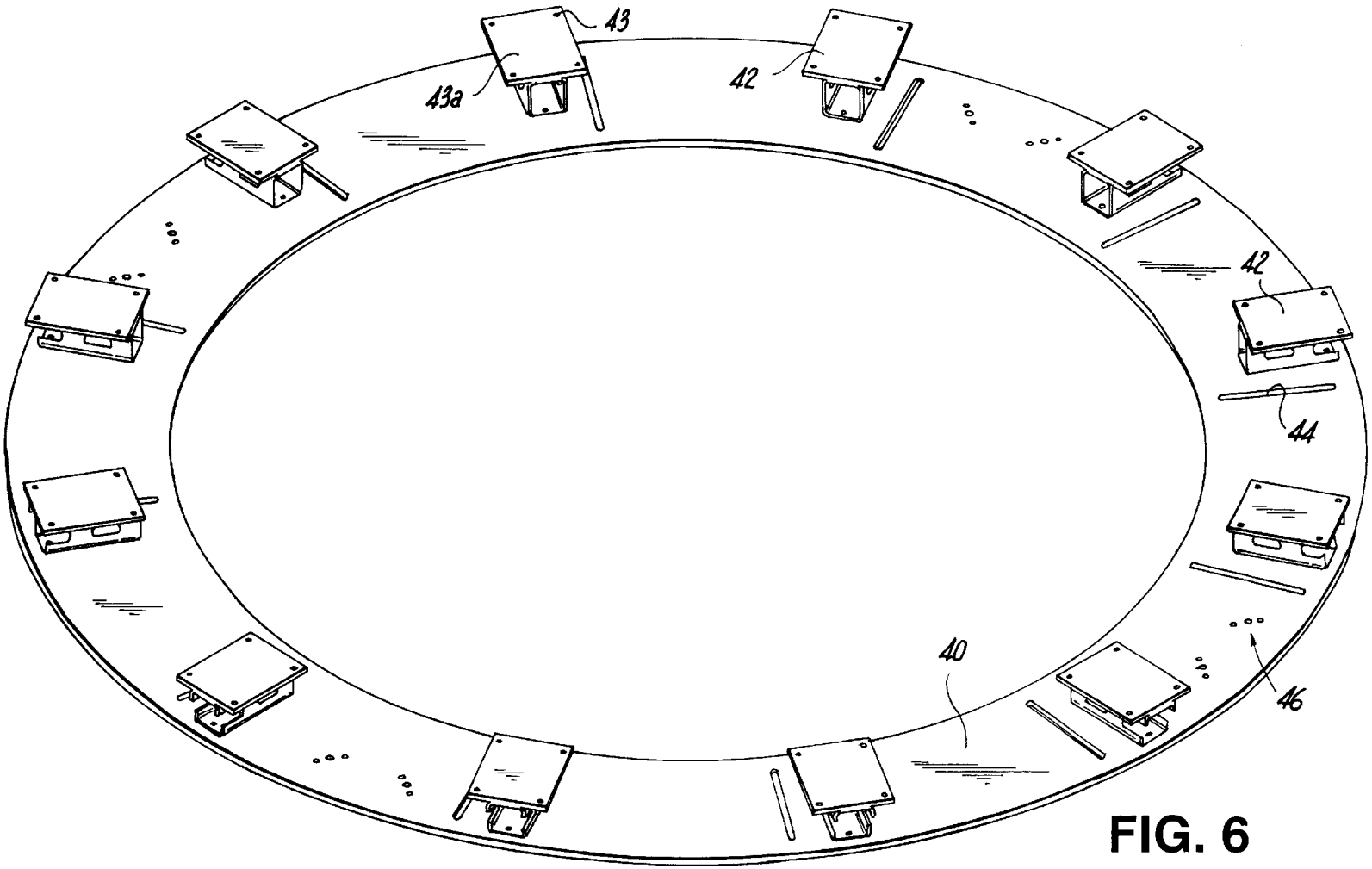
FIG. 6 is a perspective view of a leaf support plate for a former ring according to the present invention.

FIG. 6 is a perspective view of a leaf support plate 40 for a former ring. The plate 40 supports the orientation and movement of the leaves 12 and may have a hexadecimal shape. The plate 40 includes leaf plate guide parts 42 with an upper securing plate 43*a*, radial slots 44 and leaf plate lower bolts 46. The leaf plate guide parts 42 interacts with other parts of the former ring 10 to position the leaves 12 and support their movement during operation of the former ring 10. The upper securing plate 43*a* of the guide parts 42 secure the leaf support plate 40 to the top support frame 20 based on a fixed connection to the top support lower bolts 26. The radial slots 44 support movement of the leaves 12 as they are positioned around the leaf support plate 40, as further described with regard to FIGS. 10 and 11 below. The lower bolts 46 may secure this plate 40 to a plate (not shown) beneath this plate 40.

Figure 7:
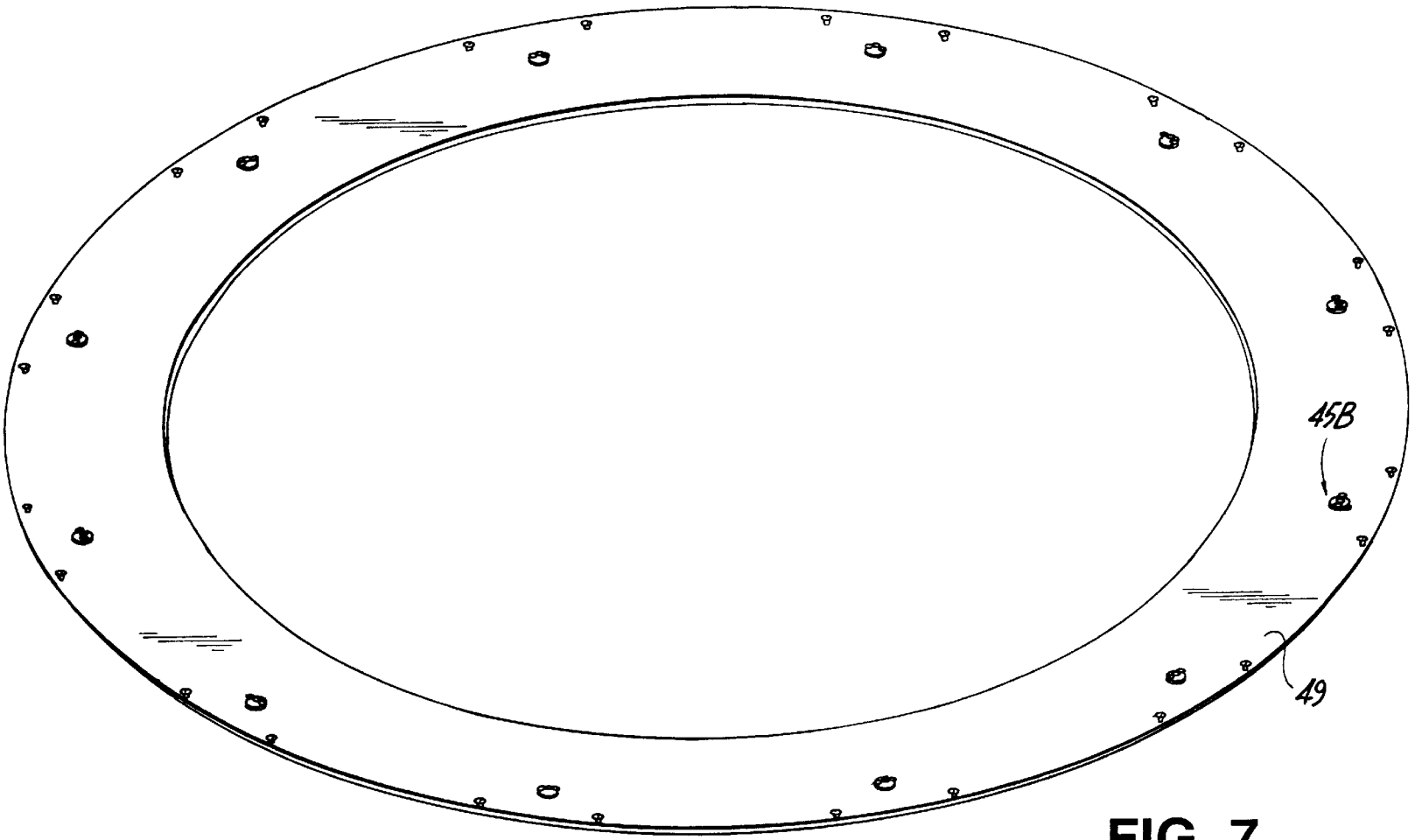
FIG. 7 is a perspective view of a bottom support plate for a former ring according to the present invention.

FIG. 7 is a perspective view of a bottom support plate 49 of a former ring. Plate 49 includes trunnion assembly 45B, described further regarding FIG. 12.

Figure 8:
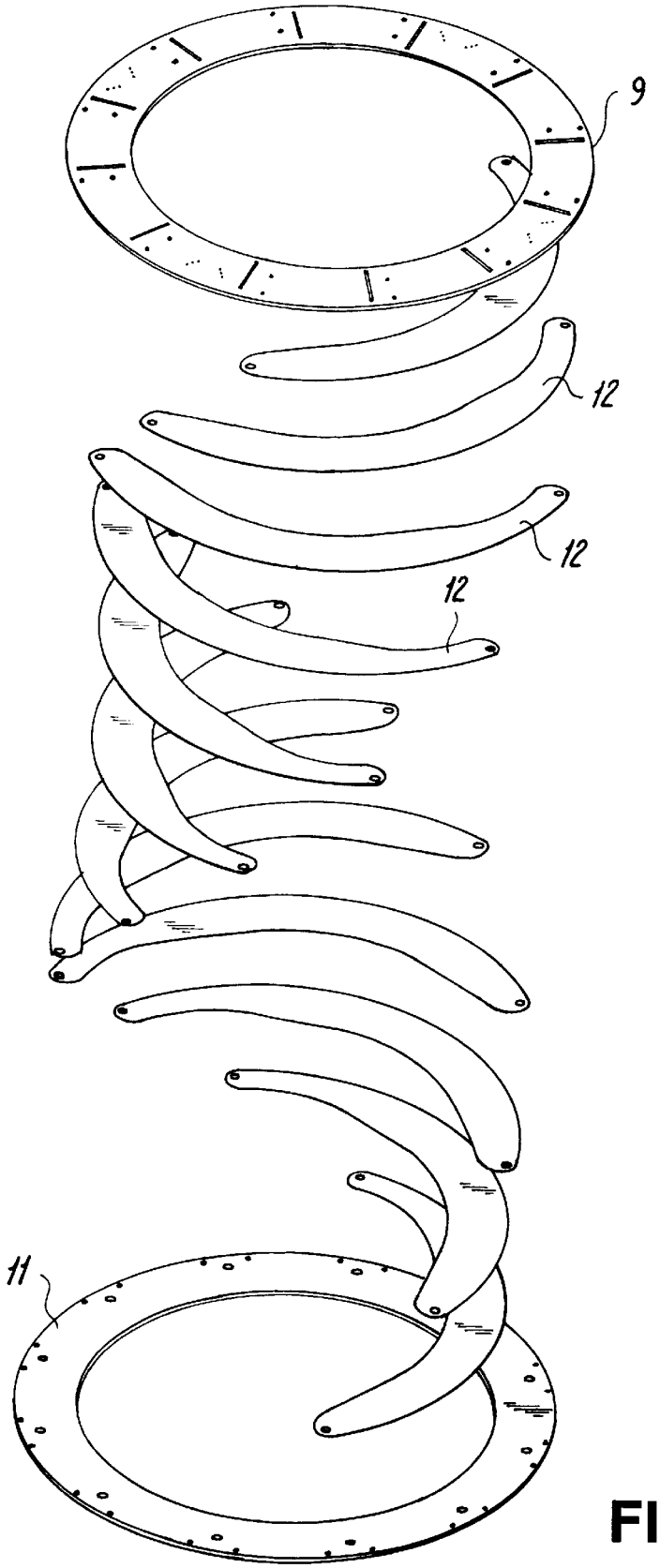
FIG. 8 is a perspective view of the orientation of the leaves with respect to a former ring according to the present invention.

FIG. 8 is a perspective view of the orientation of the leaves 12 with respect to a former ring. In this embodiment, the leaves 12 are oriented in a fanned and interlocked relationship with one another and with equal spacing between each other. The fanned feature may be analogized to a deck of cards that are fanned to enable display of a number of cards at the same time. The interlocking feature means that the fanned leaves 12 are oriented to form a complete circle such that there is overlapping of the leaves 12 and further connections of opposite sides of each leaf 12 to a separate one of the plates 9 and 11 in between which the leaves 12 are sandwiched. It should be understood that plate 9 may be a leaf support plate 40 and plate 11 may be a bottom support plate 49, and vice versa.

Figure 9:
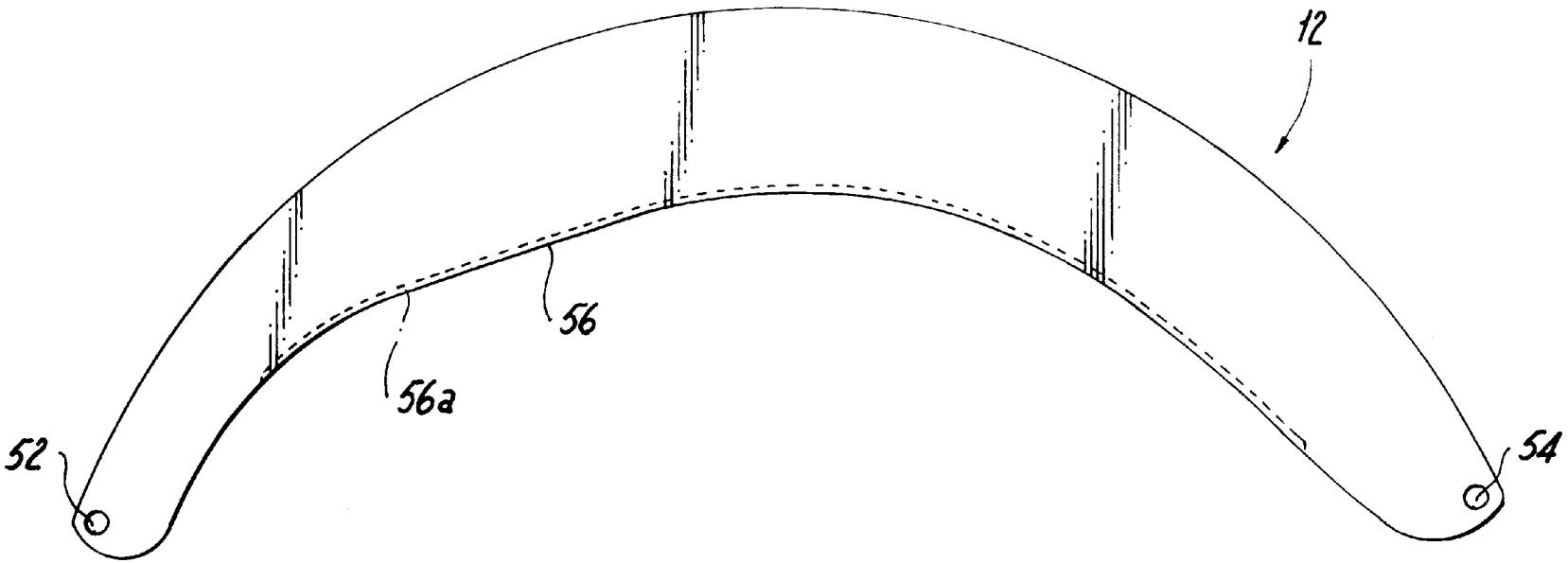
FIG. 9 is a top view of a single leaf of a former ring according to the present invention.

FIG. 9 is a top view of a single leaf 12 of a former ring. In this embodiment, the shape of the leaf 12 is configured to form a shape of an orifice when the collection of leaves 12 in the former ring 10 overlap (for example, to form a circular orifice). The leaf 12 also includes an inner circumference 56 with a portion 56*a* that deviates from a curve in order to facilitate operation or construction of the leaves 12 including to form a particular shape of the orifice formed by the collection of the leaves 12, a fixed contact point 52 with plate 9 and a moveable connection point 54 with plate 11. In this embodiment, plate 9 may be a bottom support plate 49 and plate 11 may be a leaf support plate 40.

Figure 10:
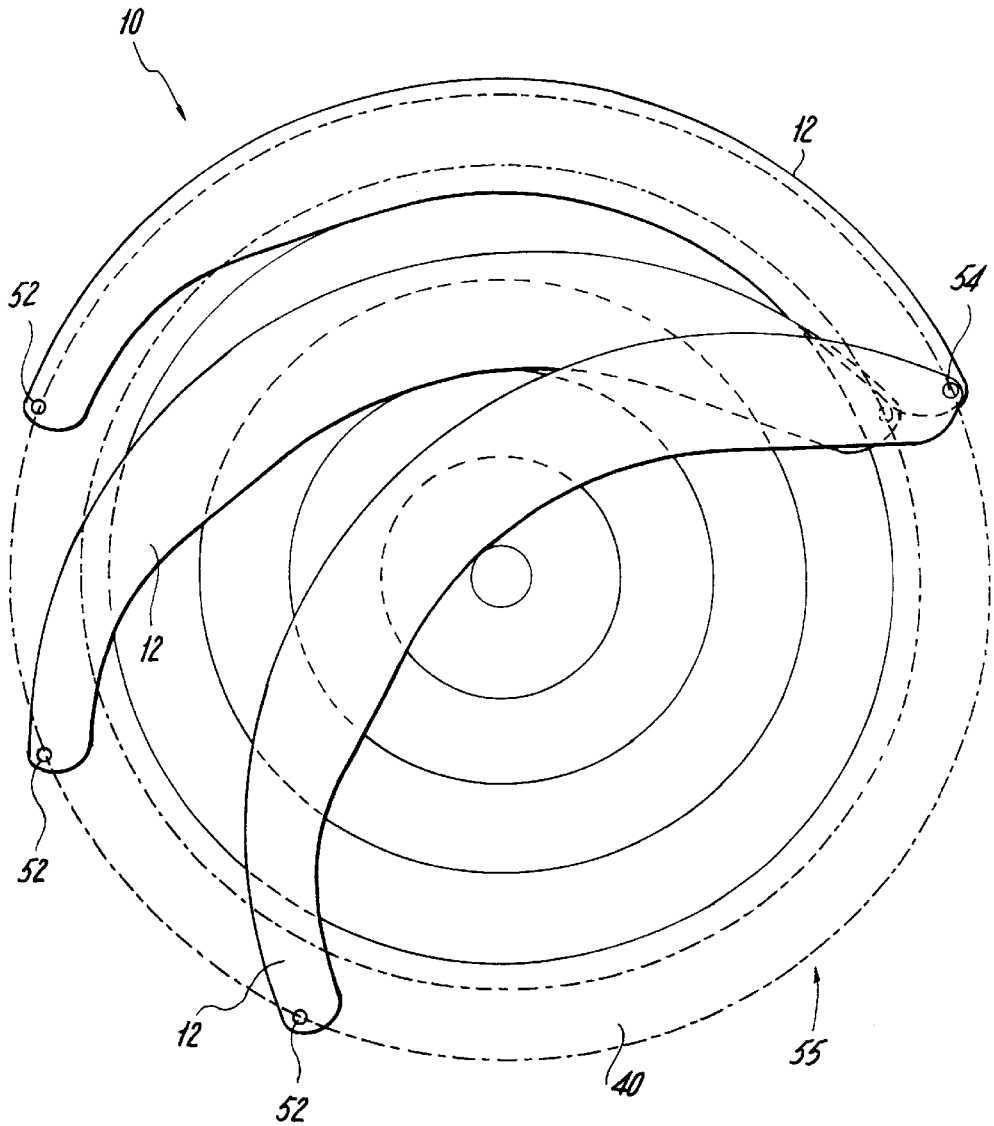
FIG. 10 is a top sectional view of two leaves, their connection a leaf support plate and their extreme positions based on rotation of a former ring according to the present invention.

FIG. 10 is a top sectional view a leaf 12, its connection to a leaf support plate 40 and the extreme positions of the leaf 12 based on rotation of the former ring. The leaf 12 includes connection points 52 and 54, connection point 52 being fixable to plate 9, e.g., a bottom support plate 49, and connection point 54 being slidable within a slot 44 of the leaf support plate 40. This configuration enables the leaf 12 to rotate such that when movement is initiated through the connection point 52, the connection point 54 of leaf 12 is repositioned. As the leaf 12 is oriented within a circular frame 55, the connection point 54 movement varies along a radius of the circular frame 55. In this embodiment, the angle between the radius defining the starting point of connection point 52 and the radius defining the ending point of connection point 52 for the full range of motion of each leaf 12 is 90 degrees based on a geometry of twelve leaves 12 and the configuration of the leaves. The particular construction or orientation of the collection of leaves 12 in the former ring does not limit this invention because there are numerous methods for constructing and orienting the leaves 12 in order to provide an adjustable orifice.

Figure 11:
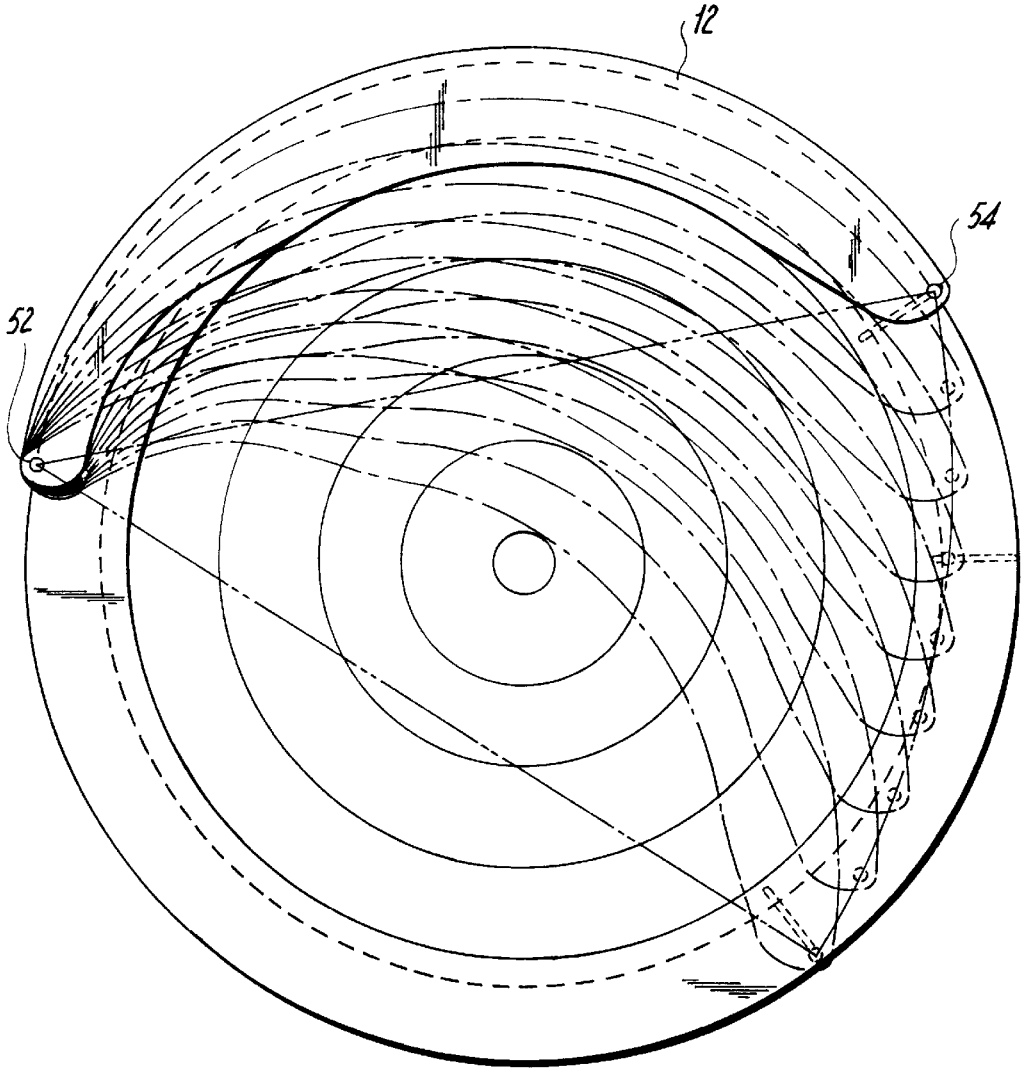
FIG. 11 is a plan view of a single leaf in various positions based on rotation of a former ring according to the present invention.

FIG. 11 is a plan view of a single leaf in various positions based on the rotation of an embodiment of the present invention. The fixed contact point 52 for the leaf 12 is connected to plate 49. As plate 40 is rotated, the sliding connection point 54 for the leaf 12 is moved in an arc pattern generally in the vicinity of the plate 49 circumference. Due to the rigid leaf 12 structure, the sliding connection point 54 also moves along the radius of the plate 40. This movement occurs within slots 44.

Figure 12:
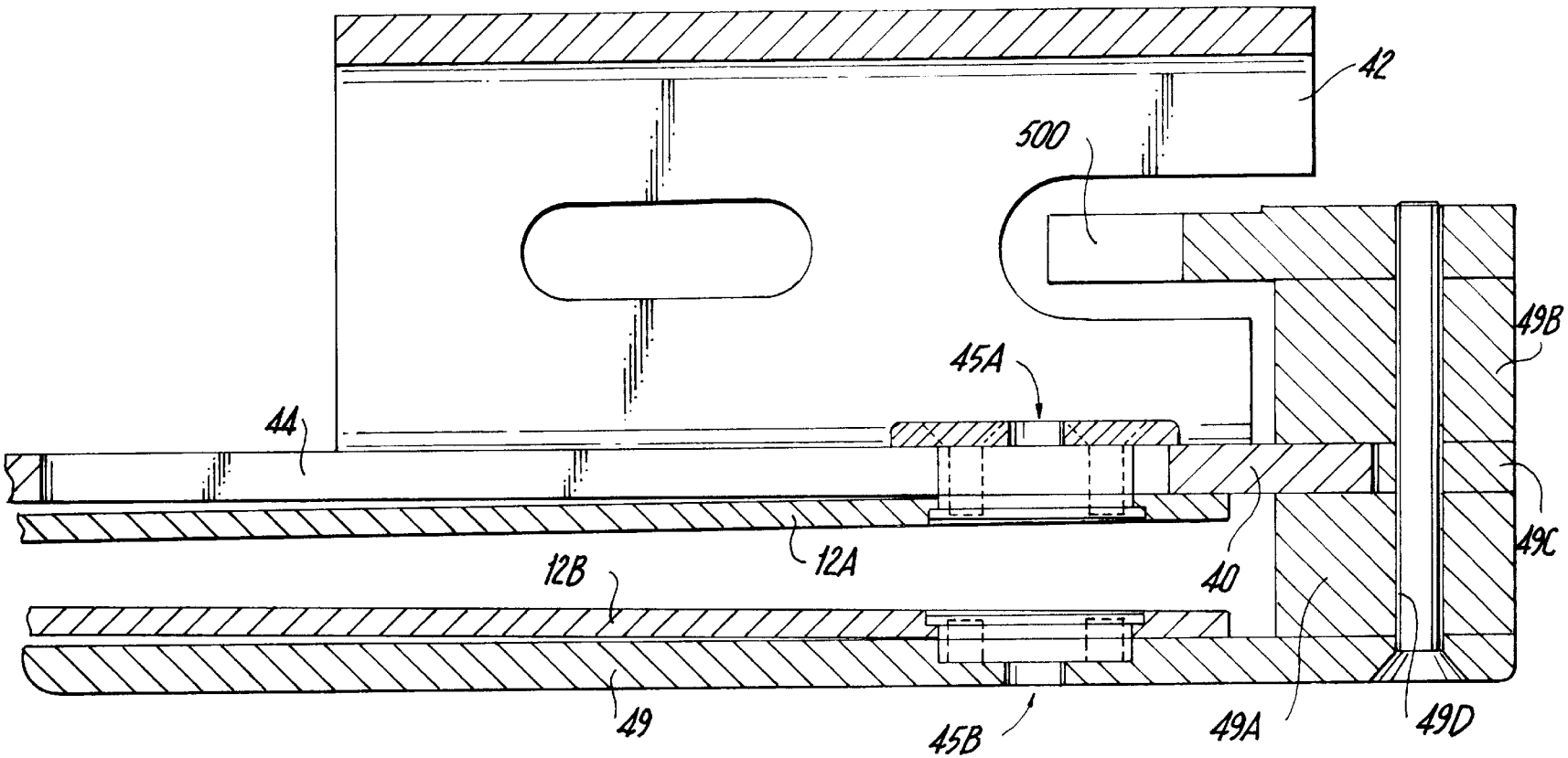
FIG. 12 is a sectional view of the leaf support plate, two leaves and the bottom support plate with a former ring driver section of a former ring according to the present invention.
Figure 18:
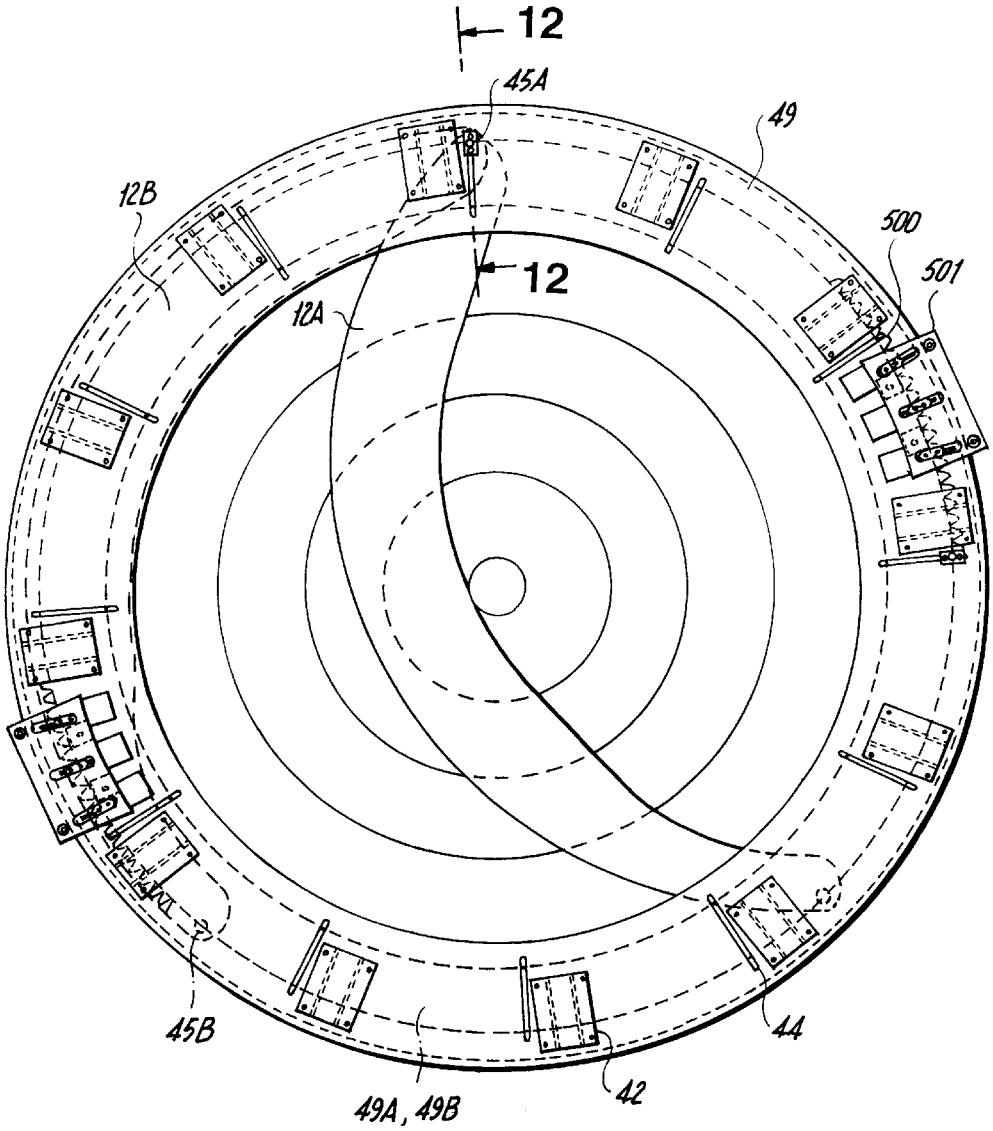
FIG. 18 is a plan view of a former ring according to the present invention.

FIG. 12 is a sectional view of the leaf support plate 40, two leaves and the bottom support plate 49 with a former ring driver section of the present invention along line 12—12 of FIG. 18. Plate 40 includes the mounting bracket 42 used to attach the top support frame 20 to the leaf support plate 40. Also included in FIG. 12 are spacers 49A that separate plates 40 and 49, the teeth assembly 500, the spacer 49B that separates the teeth assembly from plate 40, two leaves 12A and 12B (shown 180 degrees apart in the finished assembly) with trunnion 45A and 45B—one slidably attached to plate 40 with a slide trunnion 45A and one fixedly attached to plate 49 with a pivot trunnion 45B. During the opening and closing action of the former ring 10, the slide trunnion 45A mounted in the slot 44 in plate 40 limits the movement of the end of leaf 12 in a linear movement radially to the circle created by the collection of leaves 12. During the opening and closing action of the former ring 10, the pivot trunnion 451B mounted in the rotating plate 49 limits the movement of the opposite end 52 of the leaf 12 to a pivot action.

The operation of the sector with the teeth in moving the leaves is as follows. A power source, described regarding FIGS. 13 to 17, rotates the teeth assembly, which is connected to plate 49 by the component including spacers 49A, 49B and 49C that are bolted together with fastener 49D. In addition, the combination of the teeth assembly 500, plate 49 and the connection between them 49A, 49B, 49C and 49D rotate independently of plate 40 and upper alignment and bolt unit 42. Therefore, when the teeth assembly 500 is supplied with power so that it rotates, the rotation is translated to plate 49 and thereby to fixed ends 52 of leaves 12. As a result, the leaves' 12 fixed ends 52 rotates in order to adjust the inner diameter of the former ring 10.

Figure 13:
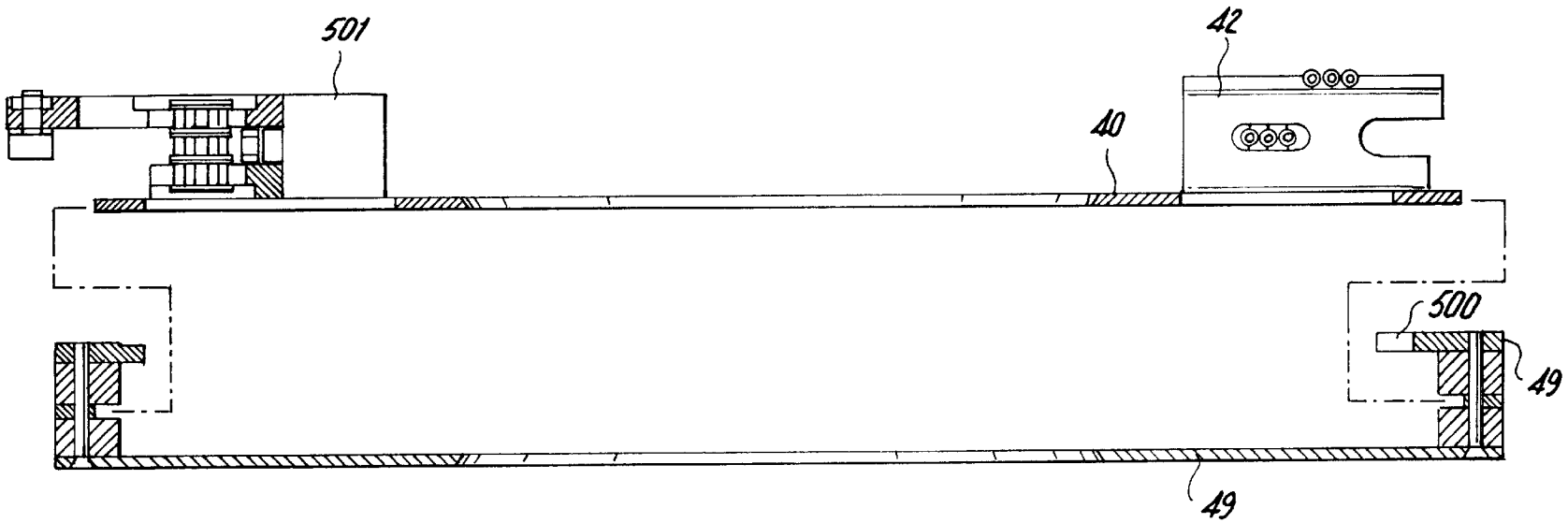
FIG. 13 shows side sectional views of a former ring driver section, a teeth assembly used to provide movement of the leaves and the plates used to support these components of a former ring according to the present invention.

FIG. 13 shows a side sectional views of the former ring driver section 501, the teeth assembly 500 used to provide movement of the leaves 12 and the plates 40 and 49 used to support the components of the former ring 10.

Figure 14A:
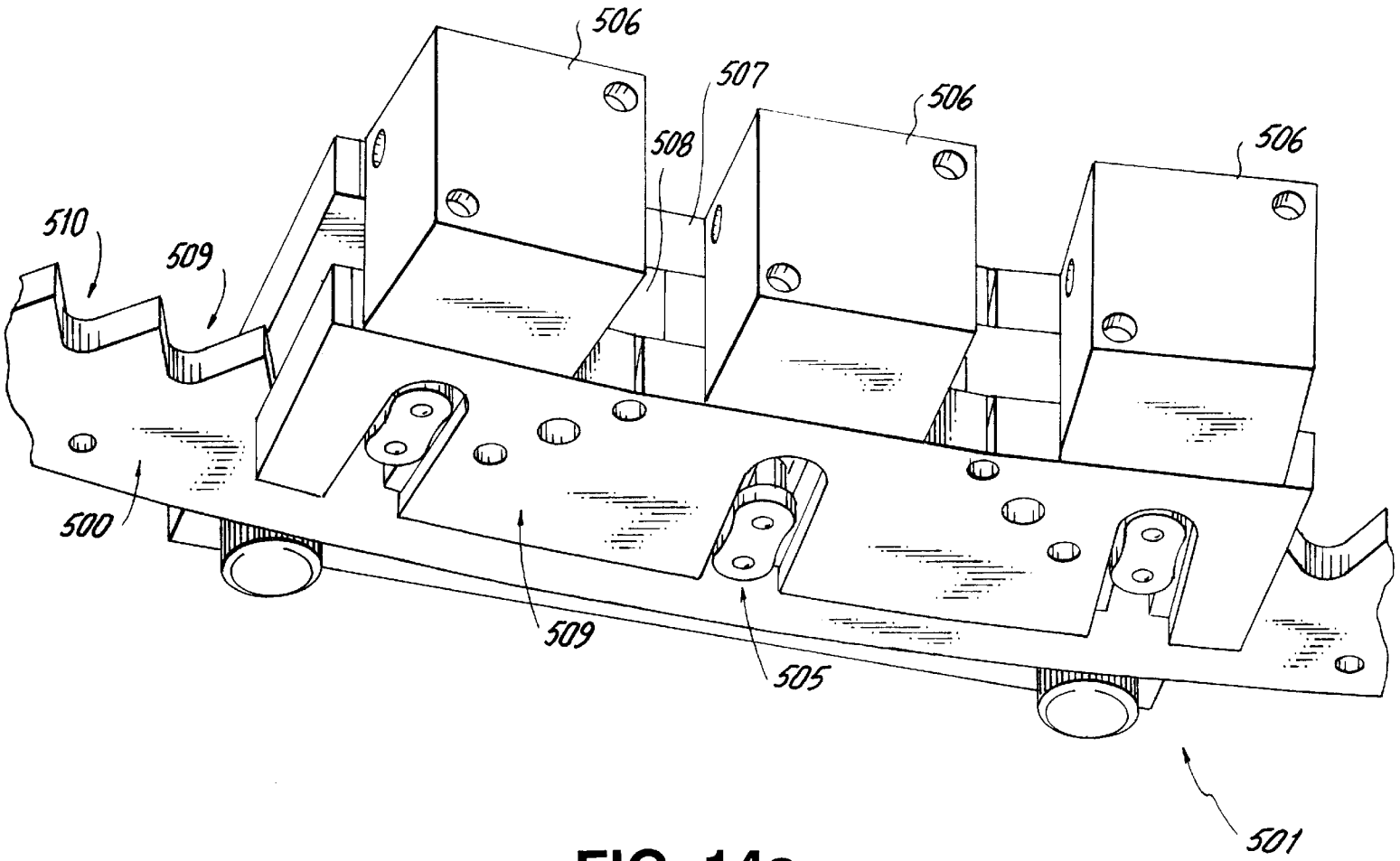
FIG. 14*a* is a perspective bottom view of a former ring driver section of a former ring according to the present invention.
Figure 14B:
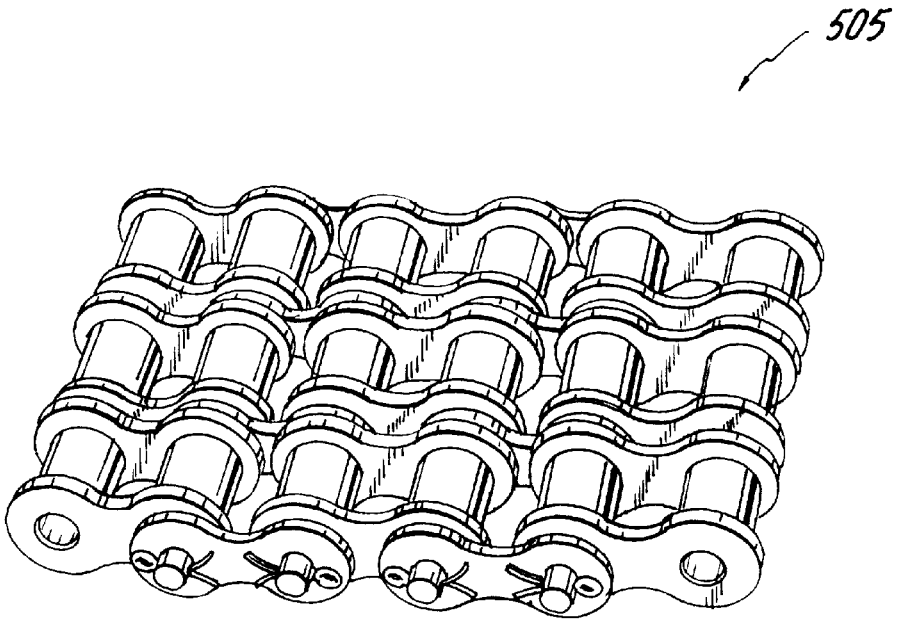
FIG. 14*b* shows a perspective view of a roller chain of a former ring according to the present invention.
Figure 14C:
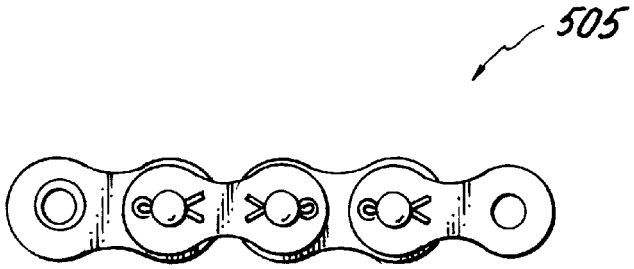
FIG. 14*c* shows a top view of the roller chain of FIG. 14*b*.

FIG. 14*a* is a perspective bottom view of the former ring driver section 501 and a sector of the teeth assembly 500. The driver section 501 contains the mechanical components used to drive the teeth assembly 500 and subsequently drive plate 49 and the attached leaves 12. The driver section 501 remains stationary during the former ring 10 activation and is mounted to the plate 40. The three air cylinders 506 are activated in a sequential manner described in detail regarding FIG. 19. When energized, each of the pistons of the air cylinders 506 extend and push a roller chain triple link 505 against a tooth 510 of the teeth assembly 500. The roller chain triple link 505 may be any suitable roller chain such as is commercially available with the model name "Triple Strand Roller Chain" and model number 50-3 from Browning Corp. (Maysville, Ky.). An exemplary model of a roller chain is shown in a perspective view and a top view in FIG. 14*b* and FIG. 14*c*, respectively, although a quadruple strand roller chain is shown rather than a triple strand.

Upon actuation, each of the links 505 pushes against one of three parts of each tooth 510 because the air cylinders 506 are configured to operate on a portion of the teeth 510 at a time. In FIG. 14*a*, for example, one roller chain 505 pushes against the ramp portion 509 of an individual tooth 510 to cause the teeth assembly 500 to rotate the distance of one third of the width of a tooth 510. The link 505 comes to rest in the root of the tooth 510 and another one comes to rest near the top of the next tooth 510 positioned to move the teeth ring 500 to the next position.

Figure 15:
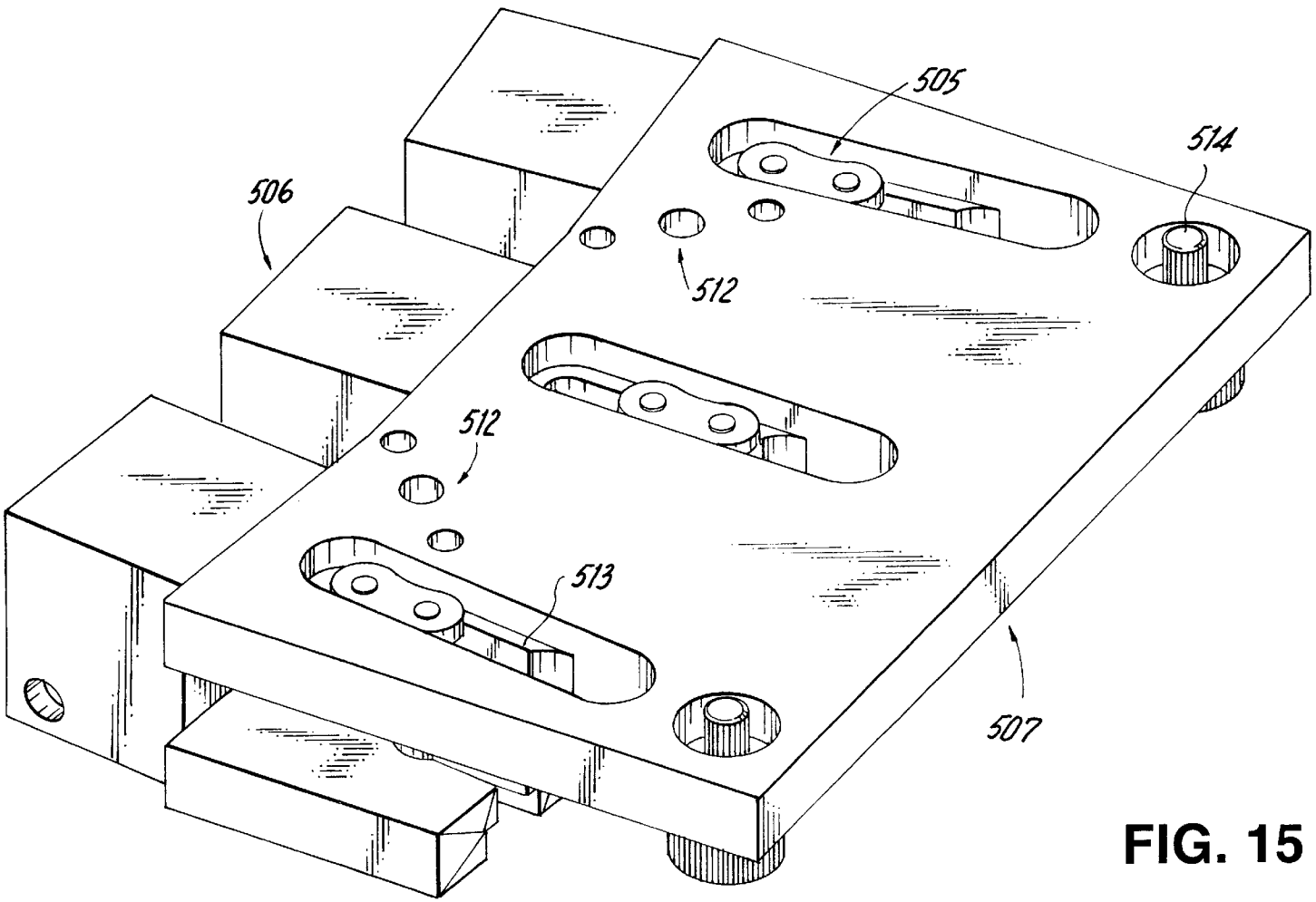
FIG. 15 is a perspective top view of a former ring driver section of a former ring according to the present invention.

FIG. 15 is a perspective top view of a former ring driver section 501 of the former ring. A driver section top plate 507 contains mounting fastener holes 512 used to secure the driver section top plate 507 to the plate 40 via bolts 46. The movement of the roller chain triple links 505 are controlled by the tracks 513 in the top plate 507. The resultant forces generated from the roller chain triple link 505 pushing against the teeth 509 of the teeth ring 500 are offset by cam followers 514. The cam followers 514 react to the air cylinder force, while allowing free rotation of the lower assembly 40. The cam followers 514 roll on the outer periphery of the plate 40.

Figure 16:
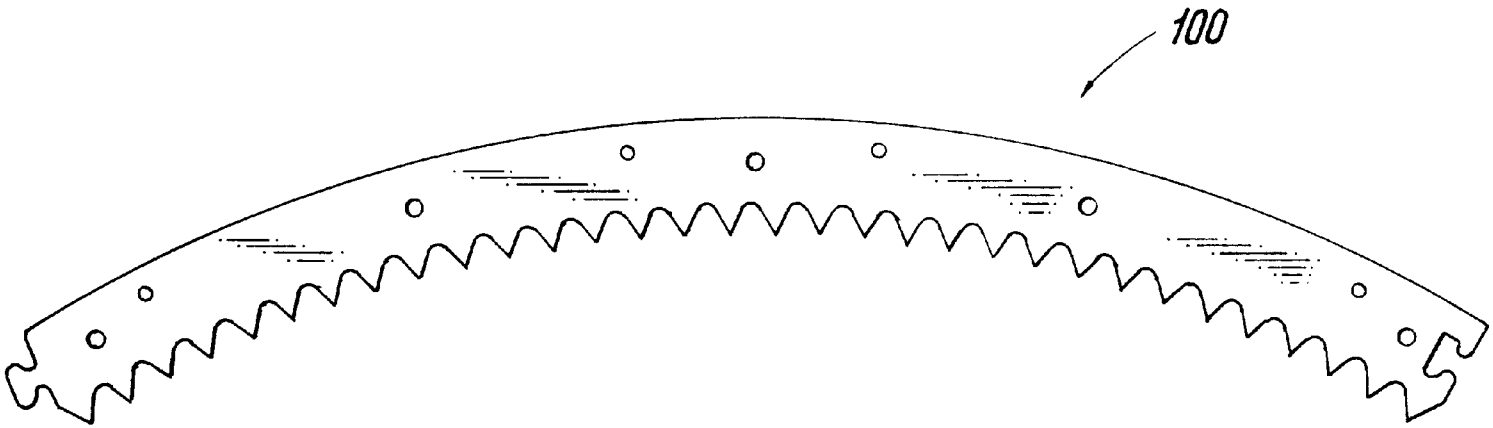
FIG. 16 is a top view of a sector with teeth powered by a former ring driver unit used for rotation of a former ring according to the present invention.

FIG. 16 is a top view of a sector with teeth 100 that is part of the teeth assembly 500. The individual sectors 100 of the teeth assembly 500 ring may be joined by press fit dovetail joints to make one continuous ring of teeth for the teeth assembly 500.

Figure 17:
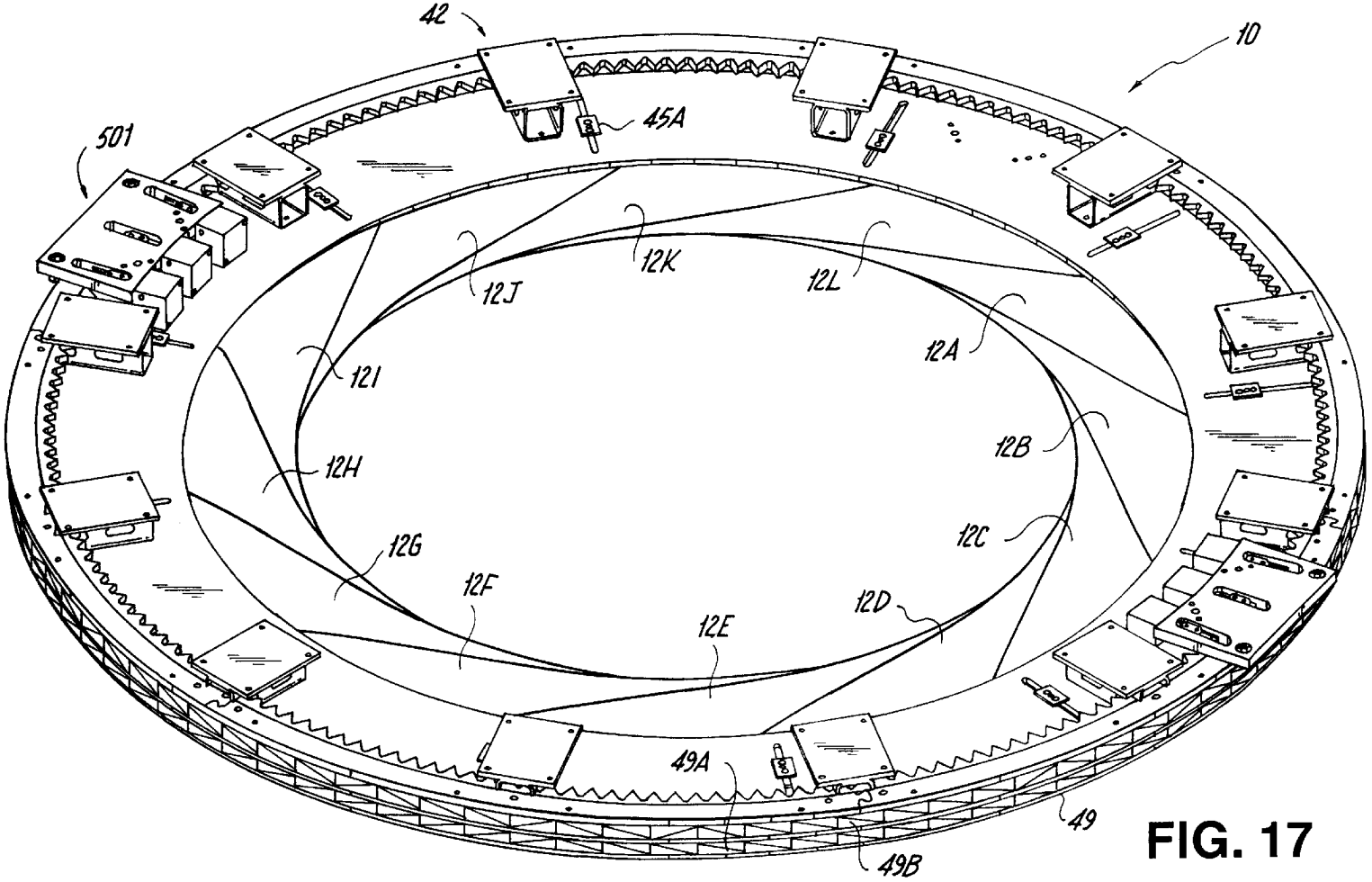
FIG. 17 is a perspective view of a former ring according to the present invention.

FIG. 17 is a perspective view of a former ring 10 having twelve leaves 12A though 12L. Two ring driver sections 501 are positioned 180 degrees apart to balance forces on the former ring, although any number of driver sections may be used in any orientation. The former ring 10 may be positioned axially and/or radially by a suitable large diameter bearing or bearings are known in the art. One end of leaf 12A is attached to the stationary plate 40 with a trunnion slide 45A. The opposite end of the leaf 12A is attached to the rotating plate 49.

FIG. 18 is a plan view of a former ring 10 showing the following components: former ring driver section 501, trunnion components 45A and 45B, plate 49 and spacers 49A and 49B and upper alignment and bolt unit 42.

Figure 19:
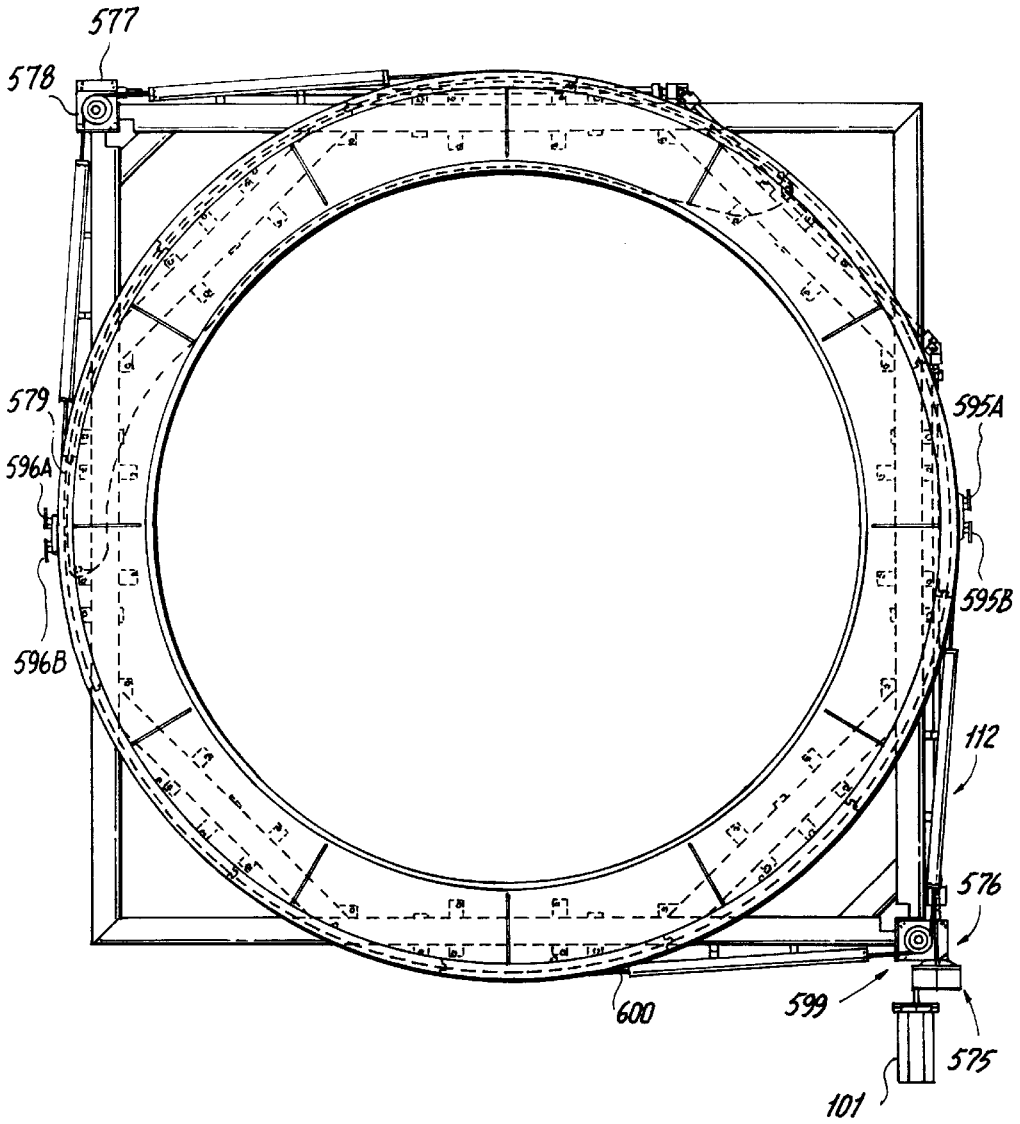
FIG. 19 is a top view of a former ring driver section controlled by a servo motor of a former ring according to the present invention.

FIG. 19 is a top view of an alternative embodiment of a former ring driver section used to drive plate 49. A servo motor 101 attached to a gearbox reducer 575 is connected to a worm drive gearbox 576 that drives a drive shaft 112 that transmits rotational drive around the assembly to an additional gearbox 577. The gearbox 577 drives a chain sprocket 578 that drives a length of chain 579 that is attached to the lower ring 49 at attachment points 596A and 595A. The gearbox 576 drives a chain sprocket 599 that drives a length of chain 600 that is attached to the lower ring 49 at attachment points 596B and 595B. Activating the servo motor 110 translates the rotation of the motor 110 through the drive assembly and causes the sprocket 578 to drive the chain 600 and 579, which rotates the plate 49, and thereby causing the former ring 10 leaves 12 to open and close, depending on the direction of rotation of the motor 110.

Although the above describes exemplary means for actuating the former ring, any suitable mechanism may be used as will be appreciated by those in the art. Furthermore, while the above describes exemplary designs capable of adjusting the inner diameter of the former ring, the invention encompasses any device that adjusts the size of the inner diameter of the former ring. Accordingly, many different leaf orientations and former ring constructions and operations may be utilized to implement the invention.

Figure 20:
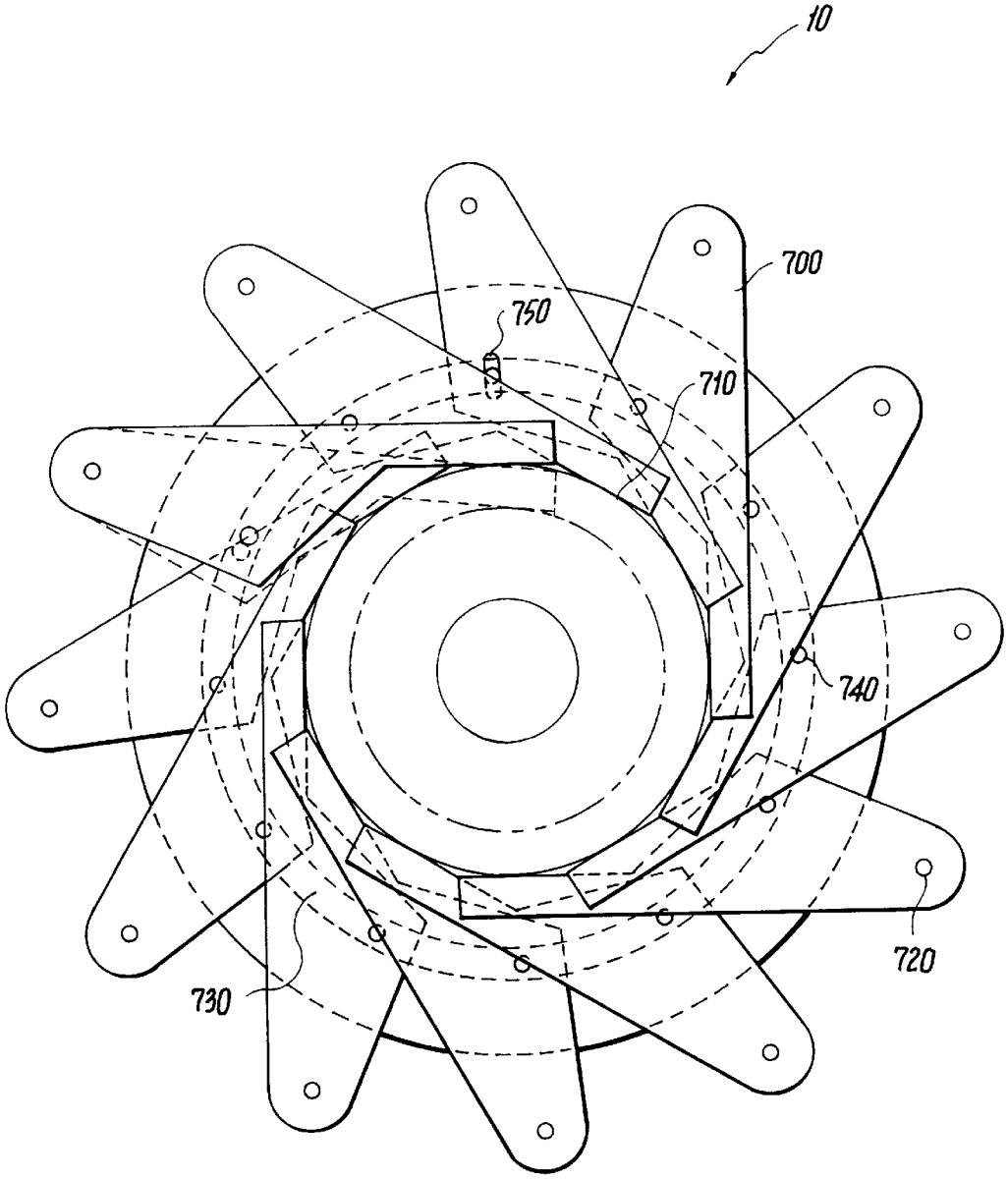
FIG. 20 is a plan view of a former ring according to the present invention.

One such an alternative embodiment is shown in FIG. 20. The former ring has a plurality of blades 700, in this embodiment twelve blades, arranged such that edges 710 of the blades form an orifice in the former ring 10. The former ring 10 is shown in an open position. Each blade 700 is pivotally attached toward its outer end to a stationary structure (not shown) by a pivot 720. The former ring 10 has a rotatable ring 730. The blades 700 are guided by the rotatable ring 730 via pins 740 on the ring 730 engaging slots 750 in the blades 700.

The diameter of the orifice is varied by rotating the ring 730 so as to rotate the blades 700 around their pivots 720 and change their radial orientation. The ring 730 is rotated by a former ring driver device (not shown), which may be of a type described above but may be any suitable mechanism. The slots 750 permit relative radial movement of the pins 740 and the blades during rotation of the ring 730. The embodiment of the invention shown in FIG. 21 has eight blades 700 instead of twelve, and the former ring 10 is shown in the closed position.

Figure 21:
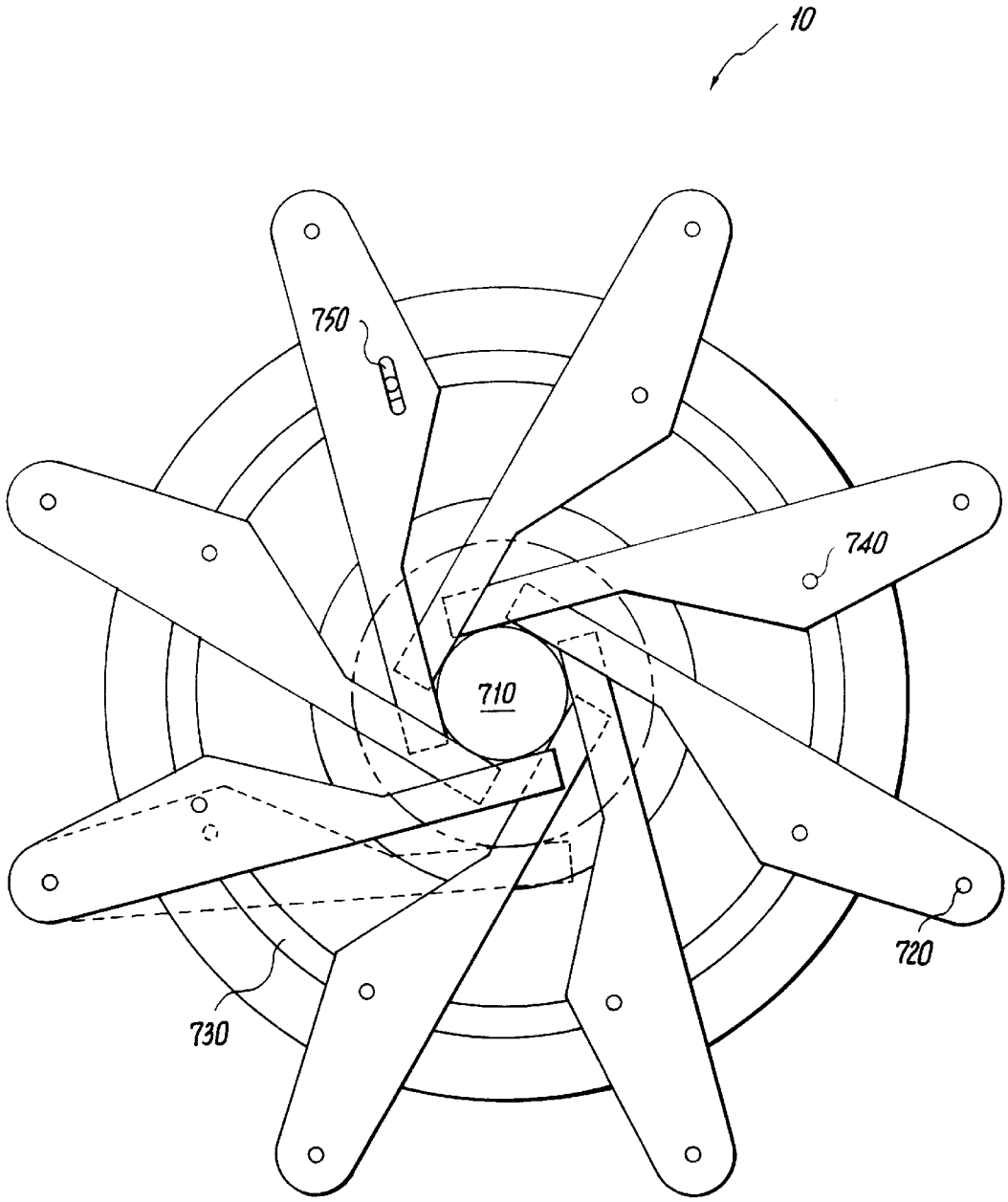
FIG. 21 is a plan view of a former ring according to the present invention.

It should be noted that in FIGS. 20 and 21, the blades 700 are equally spaced and their edges 710 are straight so that the orifice is polygonal in shape. Due to the greater number of blades shown in FIG. 20, the orifice more closely approximates a circle than that depicted in FIG. 21. However, similar to as discussed above regarding former rings utilizing leaves, the shape of the orifice may be controlled via the number, spacing, configuration and shape of the blades. For example, the edges of the blades may be curved so that the blades collectively form a circular orifice.

It should also be noted that the blades shown in FIG. 20 are "right-handed" blades, while the blades shown in FIG. 21 are "left-handed" blades. In other words, the orifice shown in FIG. 20 is actuated toward the closed position by rotating the ring 730 counterclockwise, while the orifice shown in FIG. 21 is actuated toward the closed position by rotating the ring 730 clockwise. Further, while the embodiments shown in FIGS. 20 and 21 show the rotatable ring 730 located radially inward from the pivots 720, the rotatable ring 730 may be located at the pivots 730 such that the pins 740 remain stationary.

Figure 22:
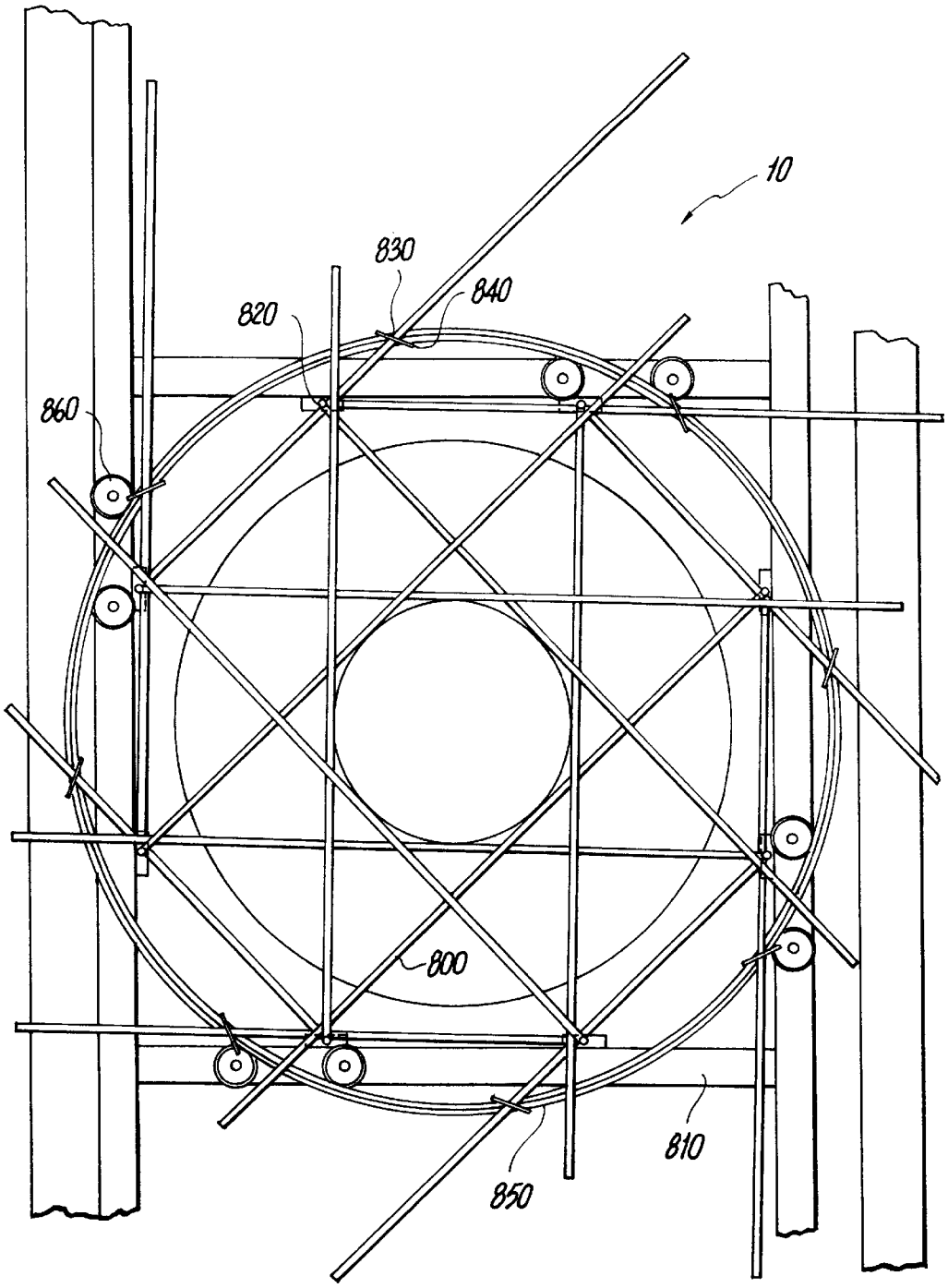
FIG. 22 is a plan view of a former ring according to the present invention.

A further embodiment of the invention is shown in FIG. 22. The former ring 10 has a plurality of rods or tubes 800 arranged to form an orifice in the former ring 10. Although referenced as rods or tubes, they may be of any shape or configuration, e.g., ⅜" diameter rods, bent rods, profiled blades, etc., and there may be any number of rods in any configuration in order to obtain a desired shape of the orifice, similar to as described above regarding leaves and blades.

Each rod is connected at one end to a stationary frame 810 by a pivot 820. The frame may be any shape or construction sufficient to support the rods 800. In the depicted embodiment, the frame is square to accommodate equally spaced rods and is rigid enough to resist deformation during braiding or actuation of the former ring. The other ends of the rods 800 pass through holes 830 in tabs 840 attached, e.g., welded, to a rotatable circular slewing ring 850. The holes 830 should be dimensioned so that the rods 800 are slidable therethrough. The slewing ring, which may be of any suitable cross section, e.g., circular, is supported by supports 860, for example, rollers, although any suitable support that allows rotation of the slewing ring 850 may be used.

In FIG. 22, the former ring 10 is shown in both an open position and a closed position. The diameter of the orifice is adjusted by rotating the stewing ring 850, rotating the rods 800 around their pivots 840. In the embodiment shown, the slewing ring 850 rotates approximately one-quarter turn (90 degrees) to actuate the former ring from the open to closed positions, which is dependent upon the configuration of the rods. As discussed above, a former ring driver device (not shown) to actuate the stewing ring 850 may be of any suitable type.

Figure 23:
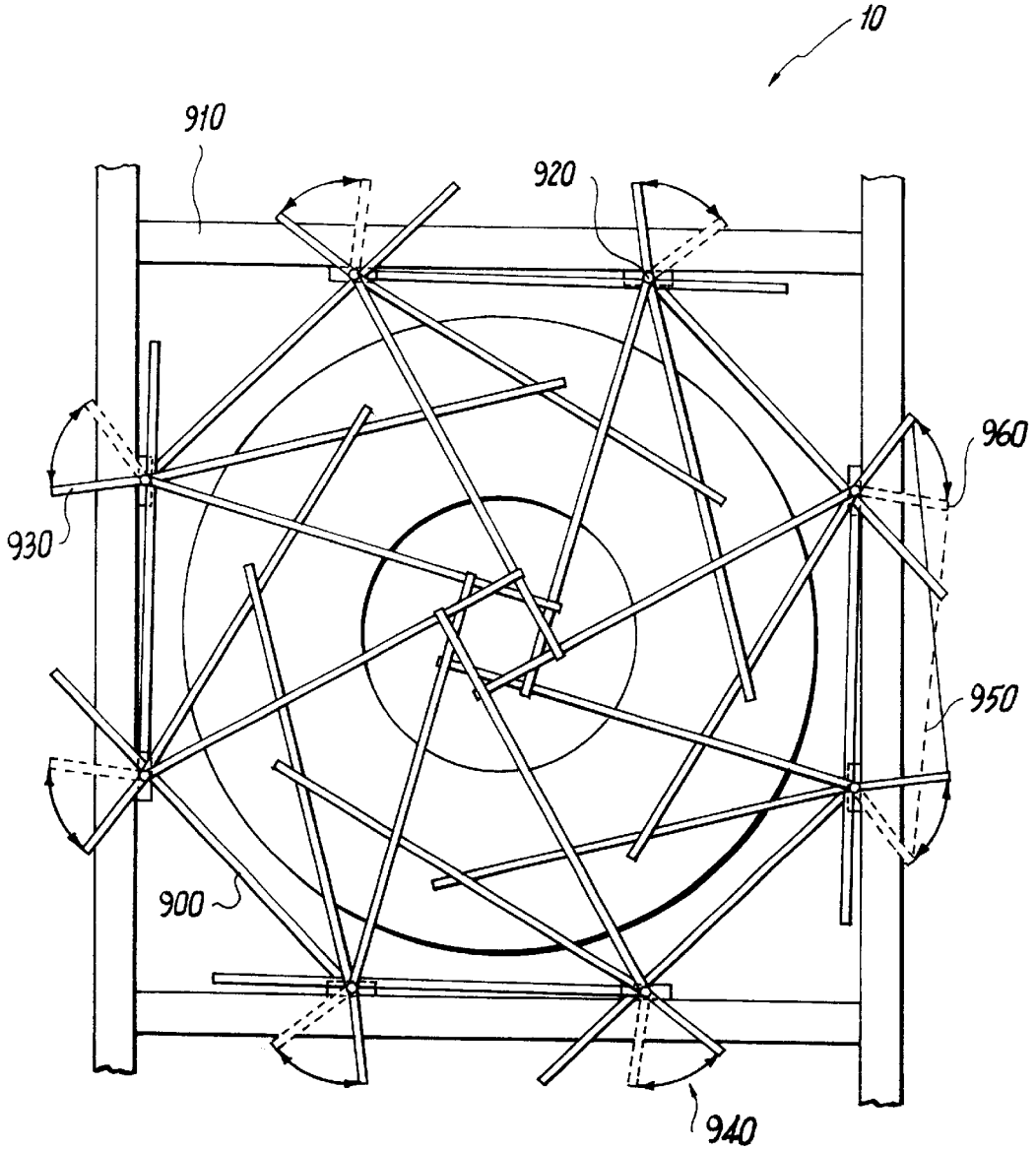
FIG. 23 is a plan view of a former ring according to the present invention.

Another embodiment of the invention is shown in FIG. 23. The former ring 10 has a plurality of rods 900 (which may be of any number, shape or configuration) cooperating to form an orifice of a desired shape in the former ring 10. Each rod 900 is connected toward one end to a support frame 910 by a pivot 920 with a rod extension 930 extending beyond the pivots 920. In FIG. 23, the support frame 910 is square and the rods are equally spaced. The length of the rods 900 may be selected so that they minimally overlap at the smallest orifice opening, e.g., one overlap.

Each rod 900 has a range of motion 940 from a fully open position to a fully closed position. The rods 900 may be actuated individually, e.g., by a servo, chain sprocket or other drive located at each pivot 920 (not shown), or the rods 900 may be actuated by an actuator or actuators (not shown) actuating more than one rod. for example, by servo-driven chain extending around ring former 10. In order to more accurately control and simplify the actuation process, a connecting rod 950 may be attached between two rods. Cammed pivots 960, e.g., cam-shaped holes and pins, may be utilized to accommodate the variations in distance between rods from an open to a closed position.

Still other embodiments of the invention may utilize slidable plates. For example, the former ring may have a series of squares with orifices that are centered and the squares are quartered so that the quarters slide in and out to alter the inner diameter.

Other alternative embodiments may use an elastic material such as rubber or any suitable elastomer with an orifice in the middle. The diameter and shape of the orifice may be changed by tensioning the material based on tension placed on the rubber.

Yet further embodiments of the invention may use rollers mounted on the end of air cylinder pistons. The cylinder assemblies may be arrayed in a circular or other fashion around the braid mandrel. The diameter and shape of the orifice may be controlled by moving the pistons, and hence the rollers, individually or in concert. A continuous surface and application of the necessary pressure to hold the braid against the mandrel may be achieved by using a sufficient number of rollers. The rollers may be equally spaced to minimize variations around the diameter of the former ring.

Additional embodiments forming an adjustable diameter orifice to be used in braiding may use a circular array of straight tubes or rods fastened at one end to a ring that is driven in a rotational fashion and the other end of the tubes or rods are sleeved through holes in a circular ring. The assembly operates similarly to the iris-type former ring described above except that the "circular" orifice is created by a series of straight edges that form a polygon. The size and resolution of the polygon are dependant on the number of tubes arrayed.

Also, other embodiments may include wrapping a series of cables around the mandrel to pull the braid up against the mandrel. By way of example, one set of cables may be wrapped in a clockwise direction around the mandrel and the other in a counterclockwise direction, 'choking' the braid-covered mandrel. The bidirectional wrapping balances the cable forces on the braid and mandrel. The cable may be loosened and tightened to adjust for variability in the mandrel diameter.

While the invention has been particularly shown and described with reference to preferred and alternative embodiments thereof, it will be understood by those skilled in the art that various changes in form and details may be made therein without departing from the spirit and scope of the invention.

What is claimed is:

1. A method of forming a braided product having at least one variation in cross section comprising:

providing a former ring having an orifice therein with an adjustable cross section;

consolidating braiding yarn into a braid at or near the former ring; and adjusting the cross section of the orifice to vary the cross section of the braid.

2. Method of claim 1 wherein adjusting the cross section includes adjusting it without pausing the braiding process.

3. A method of forming a braided product having at least one variation in cross section comprising:

providing a mandrel having at least one variation in cross section;

surrounding the mandrel with a former ring having an orifice therein with an adjustable cross section;

forming a braid onto the mandrel at a position at or near the former ring; and adjusting the cross section of the orifice so that it closely corresponds to the cross section of the mandrel to vary the cross section of the braid.

4. Method of claim 3, wherein adjusting the cross section includes adjusting it to within about a ¼" of the cross section of the mandrel.

5. Method of claim 3, wherein adjusting the cross section includes adjusting it to substantially correspond to the outside of the braided product.

6. Method of claim 3, further comprising moving the mandrel relative to the former ring such that the cross section of the mandrel is varied at the position the braid is formed thereon.

7. Method of claim 3 wherein adjusting the cross section includes adjusting it without pausing the braiding process.

8. A method of forming a multi-layered braided product comprising:

forming a first braided layer onto one of a mandrel and a previously formed braided layer;

facilitating locking the first braided layer to the one of a mandrel and a previously formed braided layer with a former ring having an orifice with an adjustable cross section therein; and forming a second braided layer onto the first braided layer.

9. Method of claim 8, wherein the mandrel has at least one variation in cross section and the facilitating step includes adjusting the cross section of the orifice to compensate for the at least one variation in cross section of the mandrel.

10. Method of claim 9, wherein adjusting the cross section includes adjusting it without pausing the braiding process.

11. Method of claim 8, wherein forming the first braided layer includes moving the mandrel in a first direction and forming the second braided layer includes moving the mandrel in a second direction.

12. A method of forming a multi-layered braided product comprising:

forming a first braided layer onto one of a mandrel and a previously formed braided layer;

facilitating locking the first braided layer to the one of a mandrel and a previously formed braided layer with a first former ring having an orifice with an adjustable cross section therein;

providing a second former ring axially displaced from the first former ring; and forming a second braided layer onto the first braided layer at or near the second former ring.

13. Method of claim 12, wherein the mandrel has at least one variation in cross section, the second ring former has an orifice with an adjustable cross section therein, the facilitating step includes adjusting the cross section of the orifice of the first former ring to compensate for the at least one variation in cross section of the mandrel, and forming the second braided layer includes adjusting the cross section of the orifice of the second former ring to compensate for the at least one variation in cross section of the mandrel.

14. Method of claim 13, wherein adjusting the cross section of the orifice of the first former ring includes adjusting it without pausing the braiding process, and adjusting the cross section of the orifice of the second former ring includes adjusting it without pausing the braiding process.

15. Method of claim 12, wherein forming the first braided layer includes moving the mandrel in a first direction and forming the second braided layer includes moving the mandrel in a second direction.

16. A braiding apparatus for braiding yarns into a braided product comprising:

a source of braiding yarns; and a former ring adapted to contact the yarns having an adjustable orifice therein.

17. Braiding apparatus of claim 16, wherein the adjustable orifice comprises a plurality of elements at least one of which is movable in at least one of a radial direction and a circumferential direction.

18. Braiding apparatus of claim 17, wherein movement of the at least one of the plurality of elements adjusts the orifice.

19. Braiding apparatus of claim 17, wherein the former ring includes at least one former ring driver unit adapted to move the at least one of the plurality of elements.

20. Braiding apparatus of claim 19, wherein the at least one former ring driver unit is adapted to move the at least one of the plurality of elements without pausing braiding of the yarns.

21. Braiding apparatus of claim 17, wherein:

the former ring further comprises first and second supports movable relative to each other, at least one of the at least one of the plurality of elements has a first portion and a second portion with the first portion being connected to the first support and the second portion being connected to the second support, and the first support, second support, and the plurality of elements are configured such that relative movement of the first and second supports adjusts the orifice.

22. Braiding apparatus of claim 21, wherein the first and second supports are rotatable relative to each other.

23. Braiding apparatus of claim 17, wherein:

the former ring further comprises first and second supports movable relative to each other, at least one of the at least one of the plurality of elements is connected to one of the first and second supports; and wherein the first support, second support, and the plurality of elements are configured such that relative movement of the first and second supports adjusts the orifice.

24. Braiding apparatus of claim 23, wherein the first and second supports are rotatable relative to each other.

25. Braiding apparatus of claim 16, wherein the orifice is adapted to affect a cross section of the braided product.

26. A former ring adapted to be used with a braiding apparatus to braid yarns into a braided product having an adjustable orifice therein the former ring further being adapted to be mounted to a braiding apparatus.

27. Former ring of claim 26, wherein the adjustable orifice comprises a plurality of elements at least one of which is movable in at least one of a radial direction and a circumferential direction.

28. Former ring of claim 27, wherein movement of the at least one of the plurality of elements adjusts the orifice.

29. Former ring of claim 27, wherein the former ring includes at least one former ring driver unit adapted to move the at least one of the plurality of elements.

30. Former ring of claim 29, wherein the at least one former ring driver unit is adapted to move the at least one of the plurality of elements without pausing braiding of the yarns.

31. Former ring of claim 27, wherein:

the former ring further comprises first and second supports movable relative to each other, at least one of the at least one of the plurality of elements has a first portion and a second portion with the first portion being connected to the first support and the second portion being connected to the second support, and the first support, second support, and the plurality of elements are configured such that relative movement of the first and second supports adjusts the orifice.

32. Former ring of claim 31, wherein the first and second supports are rotatable relative to each other.

33. Former ring of claim 27, wherein:

the former ring further comprises first and second supports movable relative to each other, at least one of the at least one of the plurality of elements is connected to one of the first and second supports; and wherein the first support, second support, and the plurality of elements are configured such that relative movement of the first and second supports adjusts the orifice.

34. Former ring of claim 33, wherein the first and second supports are rotatable relative to each other.

35. Former ring of claim 26, wherein the orifice is adapted to affect a cross section of the braided product.

36. A former ring adapted to be used with a braiding apparatus for braiding yarns into a braided product having an adjustable orifice therein, the former ring further being adapted to withstand braiding forces thereon such that the braiding forces do not substantially alter the position or shape thereof.

37. Former ring of claim 36, wherein the adjustable orifice comprises a plurality of elements at least one of which is movable in at least one of a radial direction and a circumferential direction.

38. Former ring of claim 37, wherein movement of the at least one of the plurality of elements adjusts the orifice.

39. Former ring of claim 37, wherein the former ring includes at least one former ring driver unit adapted to move the at least one of the plurality of elements.

40. Former ring of claim 39, wherein the at least one former ring driver unit is adapted to move the at least one of the plurality of elements without pausing braiding of the fibers yarns.

41. Former ring of claim 37, wherein:

the former ring further comprises first and second supports movable relative to each other, at least one of the at least one of the plurality of elements has a first portion and a second portion with the first portion being connected to the first support and the second portion being connected to the second support, and the first support, second support, and the plurality of elements are configured such that relative movement of the first and second supports adjusts the orifice.

42. Former ring of claim 41, wherein the first and second supports are rotatable relative to each other.

43. Former ring of claim 37, wherein:

the former ring further comprises first and second supports movable relative to each other, at least one of the at least one of the plurality of elements is connected to one of the first and second supports; and wherein the first support, second support, and the plurality of elements are configured such that relative movement of the first and second supports adjusts the orifice.

44. Former ring of claim 43, wherein the first and second supports are rotatable relative to each other.

45. Former ring of claim 36, wherein the orifice is adapted to affect a cross section of the braided product.

46. A braiding apparatus for braiding yarns into a multilayered braided product comprising:

a first former ring adapted to facilitate braiding of the yarns; and a second former ring adapted to contact the braiding yarns, the second former ring being axially displaced from the first former ring and having an adjustable orifice therein.

47. Braiding apparatus of claim 46, wherein the first former ring includes an adjustable orifice therein.

48. Braiding apparatus of claim 46, wherein the second former ring is adapted to facilitate locking of a braided layer onto a mandrel or another braided layer.

49. Braiding apparatus of claim 46, further including a mandrel movable in at least a first direction and a second direction.

50. Braiding apparatus of claim 46, wherein the second former ring is adapted to compensate for any variation in a cross section of a mandrel.

51. Braiding apparatus of claim 46, wherein the second former ring includes a former ring drive unit adapted to adjust the orifice.

52. Braiding apparatus of claim 51, wherein the ring drive unit is adapted to adjust the orifice without pausing braiding of the yarns.

* * * * *